US005336278A

United States Patent [19]

Adams et al.

[11] Patent Number: 5,336,278

[45] Date of Patent: Aug. 9, 1994

[54] FUEL COMPOSITION CONTAINING AN AROMATIC AMIDE DETERGENT

[75] Inventors: Paul E. Adams, Willoughby Hills; Richard M. Lange, Euclid; Stephen H. Stoldt, Concord Township, Lake County, all of Ohio

[73] Assignee: The Lubrizol Corporation, Wickliffe, Ohio

[21] Appl. No.: 61,377

[22] Filed: May 13, 1993

[51] Int. Cl.[5] ..... C10L 1/22

[52] U.S. Cl. ..... 44/419; 44/341; 44/344; 44/349; 44/351; 44/418

[58] Field of Search ..... 44/418, 419, 341, 344, 44/349, 351

[56] References Cited

U.S. PATENT DOCUMENTS

| | | | |
|---|---|---|---|
| 2,933,520 | 4/1960 | Bader | 260/473 |
| 2,984,685 | 5/1961 | Holman | 260/559 |
| 3,282,939 | 11/1966 | Spivack et al. | 44/418 |
| 3,338,833 | 8/1967 | Spivack et al. | 252/47.5 |
| 3,360,464 | 12/1967 | Otto, Jr. | 252/51.5 |
| 3,954,808 | 5/1976 | Elliot et al. | 260/343.2 |
| 3,966,807 | 6/1976 | Elliot et al. | 260/559 |
| 4,051,049 | 9/1977 | Elliot et al. | 252/51.5 |
| 4,083,791 | 4/1978 | Elliot et al. | 252/51.5 |
| 4,108,784 | 8/1978 | Bryant | 44/418 |
| 4,194,886 | 3/1980 | Ripple | 44/341 |
| 4,205,960 | 6/1980 | Bryant | 44/341 |
| 4,285,824 | 8/1981 | Bryant | 44/418 |
| 4,534,874 | 8/1985 | Steinberg et al. | 252/51.5 |

FOREIGN PATENT DOCUMENTS

| | | | |
|---|---|---|---|
| 2048211 | 2/1992 | Canada | C07C 235/34 |
| 0331556 | 9/1989 | European Pat. Off. | C07C 99/00 |

OTHER PUBLICATIONS

Derwent Abstract 89-257868/36 re EP 331,556, 1989.

*Primary Examiner*—Jerry D. Johnson

*Attorney, Agent, or Firm*—Joseph P. Fischer; Frederick D. Hunter, Sr.; James L. Cordek

[57] ABSTRACT

A fuel composition comprising a major amount of a normally liquid fuel and a minor amount of at least one compound of the general formula (I)

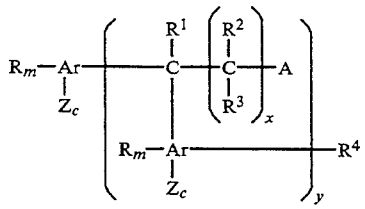

wherein each Ar is independently an aromatic group having from 4 to about 30 carbon atoms and from 0 to 3 optional substituents selected from the group consisting of amino, hydroxy- or alkyl- polyoxyalkyl, nitro, aminoalkyl, carboxy or combinations of two or more of said optional substituents, each R is independently a hydrocarbyl group, $R^1$ is H or a hydrocarbyl group, $R^2$ and $R^3$ are each, independently, H or a hydrocarbyl group, $R^4$ is a monovalent terminating group, each m is independently 0 or an integer ranging from 1 to about 10, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and at least one A is independently an amide or an amide-containing group. In one embodiment, (I) is present in an amount effective to provide total fuel intake system cleanliness in a port fuel injected internal combustion engine.

74 Claims, No Drawings

FUEL COMPOSITION CONTAINING AN AROMATIC AMIDE DETERGENT

FIELD OF THE INVENTION

This invention is directed to novel fuel compositions for internal combustion engines and to methods for using such fuel compositions.

BACKGROUND OF THE INVENTION

Over the years, fuels used in internal combustion engines have contained various kinds of additives to improve performance of the fuel or to alleviate problems arising during the use and combustion of fuels in internal combustion engines. During the 1950's and 1960's, engine designers generally focused their efforts towards the development of high-performance engines, with little concern about fuel economy or exhaust emissions. The fuel delivery system for engines of this era involved the use of carburetors to deliver an air-fuel mixture, via a manifold, to the cylinders for combustion. Primary concerns at this time were carburetor icing, adequate octane value, deposit formation on carburetor surfaces, fuel stability and the like. Additives for fuels such as anti-icing agents, lead-containing fuel additives, detergents, and various antioxidants generally resulted in adequate performance. Deposits in other parts of the fuel delivery system were not of a major concern because such engines were generally tuned to a rich air/fuel ratio allowing for mixture malfunction. Greater power-weight ratios meant that the driver was less apt to notice changes in peak power and fuel economy, and exhaust emissions were not a serious concern at that time.

It wasn't until the energy shortages of the 1970's, and, at about the same time, increased awareness of environmental concerns, that changes directed to purposes other than improving engine output began to receive widespread attention. During this time, and up to the early 1980's, government regulations in the United States and in other countries throughout the world imposed increasingly stringent limitations on exhaust emissions and on fuel consumption. Efforts to comply with these requirements involved various engine modifications, smaller vehicles, smaller engines, and increasingly widespread use of light weight materials. Only minor changes were made to fuel handling systems during this time other than efforts to control evaporative hydrocarbon emissions. During this time, consumers did become aware of the importance of fuel intake system cleanliness to maintain acceptable fuel consumption limits.

By the early 1980's, the carbureted internal combustion engine began to give way to throttle-body fuel injection systems. Such systems are described in U.S. Pat. Nos. 4,487,002 and 4,490,792 and in Bowler, SAE Paper 800164. Conventional fuel additives generally provided adequate service for this system.

In response to continuing demands for improved fuel economy, increased performance and reduced exhaust emissions, automobile manufacturers began to utilize even more sophisticated engines. One of the developments was the increased use of high specific output, lean burn engines. To meet the complex demands of increased power, fuel economy, and environmental control, these engines were tuned to operate at or near the lean limit of combustion, i.e., minimum amount of fuel. Lean burn engines require precise management of air-fuel ratios. This resulted in engines much less tolerant of deposits throughout the fuel metering and induction system. Thus, total fuel intake system cleanliness has become an important priority. Further developments in fuel metering and induction systems have resulted in engines that can operate efficiently and provide excellent performance while generating minimal objectionable emissions or emissions that are readily controlled with emission control systems such as catalysts and the like. One such development is the increasingly widespread use of fuel injection systems such as port fuel injection, also known as multi-port fuel injection, in which injectors discharge fuel into an intake runner or intake port. Such injector systems are illustrated in U.S. Pat. No. 4,782,808, the disclosure of which is hereby incorporated herein by reference thereto. Each injector is normally located in close proximity to the intake valve. The injector itself is designed to close tolerances and is subject to fouling, for example, from the fuel itself or because its location, in close proximity to the intake valve, is in an environment of high temperature resulting in carbon and varnish deposit formation on the injector. Such deposits result in impaired control of fuel metering. When deposits form on the injector tip, the injector may clog causing reduction in fuel flow or at least the precise fuel spray pattern is disrupted.

Another problem that has arisen is the formation of deposits on the intake valve itself. One of the reasons proposed for the particularly severe formation of deposits in port fuel injections engines is that the fuel is sprayed upon the hot valve surface resulting in formation of carbon deposits on the valve surface.

While earlier engines were sometimes prone to the formation of deposits throughout the intake system, including on the intake valve itself, the less demanding requirements of engines operating on a rich fuel mixture tended to mask the detrimental effect on driveability. Today's more sophisticated engines often are very intolerant of such deposits, resulting in severe driveability problems such as rough idling, power loss and stalling.

The use of large amounts of conventional dispersing additives in an attempt to overcome some of these stated problems often resulted in increased deposits on the intake valve and also in valve sticking. It has been proposed that degradation of the fuel additive results in deposits that impair movement of the valve.

Accordingly, efforts are continuing to provide means for maintaining intake system cleanliness or to clean up intake systems which are already contaminated.

It is one object of this invention to provide novel fuel compositions.

It is another object of this invention to provide novel fuel compositions that promote total intake system cleanliness.

It is another object to provide novel fuel compositions for use in port fuel injected engines that prevent or reduce the formation of intake valve deposits.

Another object is to provide novel fuel compositions that meet at least one of the above-stated objects and do not contribute towards valve-sticking.

A further object is to provide a method for maintaining total intake system cleanliness in a gasoline-fueled internal combustion engine.

Still another object is to provide a method for preventing or reducing the formation of intake valve deposits in a port fuel injected engine, or for removing such deposits where they have formed.

A further object is to provide a method for preventing or reducing deposits on fuel injectors, particularly, deposits at the fuel delivery nozzle thereof.

Other objects are mentioned hereinbelow or will be apparent to one skilled in the applicable art upon reading the disclosure.

SUMMARY OF THE INVENTION

The present invention is directed to a fuel composition comprising a major amount of a normally liquid fuel and a minor amount of at least one compound of the general formula (I)

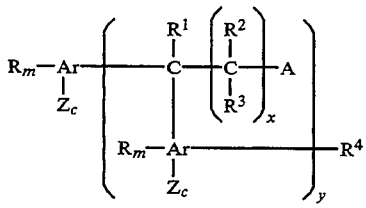

wherein each Ar is independently an aromatic group having from 5 to about 30 carbon atoms and from 0 to 3 optional substituents selected from the group consisting of amino, hydroxy- or alkyl-polyoxyalkyl, nitro, aminoalkyl carboxy or combinations of two or more of said optional substituents, each R is independently a hydrocarbyl group, $R^1$ is H or a hydrocarbyl group, $R^2$ and $R^3$ are each, independently, H or a hydrocarbyl group, $R^4$ is selected from the group consisting of H, a hydrocarbyl group, a member of the group of optional substituents on Ar, or lower alkoxy, each m is independently 0 or an integer ranging from 1 to about 6, x ranges from 0 to about 8, and each Z is independently OH, lower alkoxy $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide or an amide-containing group, a carboxyl group, an imidazoline-containing group, an oxazoline-containing group, an ester group, an acylamino group or when one Z and A are taken together, a lactone group of the formula (XIV)

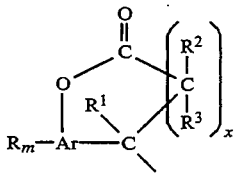

provided at least one A is an amide or an amide-containing group.

A "major amount" is defined herein as greater than 50% by weight, and a "minor amount" is less than 50% by weight. Thus, for example, 51%, 60%, 77% and 99% are major amounts, and 0.01%, 10%, 24% and 49% are minor amounts.

In one embodiment, the compound of formula (I) is present in amounts sufficient to provide total intake system cleanliness. In another embodiment, it is present in amounts sufficient to prevent or to reduce the formation of intake valve deposits or to remove same where they have formed. The presence of an additional component, a fluidizer oil, has been found to be helpful in providing enhanced detergency and reduced valve-sticking. In yet another embodiment, the fuel compositions of this invention comprise an auxiliary dispersant selected from the group consisting of Mannich type dispersants, acylated nitrogen-containing dispersants, ester dispersants, aminophenol dispersants, aminocarbamate dispersants and amine dispersants. Methods for providing total intake system cleanliness and preventing or reducing the formation of intake valve deposits or removing same, are within the scope of this invention.

DESCRIPTION OF THE PREFERRED EMBODIMENTS DETAILED DESCRIPTION OF THE INVENTION

As mentioned hereinabove, the fuel compositions contain an amide or an amide-containing compound represented by the general formula (I). Specific features and embodiments are discussed hereinbelow.

The Aromatic Moiety Ar

The group Ar is an aromatic group containing from 5 to about 30 carbon atoms and from 0 to 3 optional substituents selected from the group consisting of amino, hydroxy- or alkyl- polyoxyalkyl, nitro, aminoalkyl, carboxy or combinations of two or more of said optional substituents.

The aromatic group Ar can be a single aromatic nucleus such as a benzene nucleus, a pyridine nucleus, a 1,2,3,4-tetrahydronaphthalene nucleus, etc., or a polynuclear aromatic moiety. Polynuclear moieties can be of the fused type; that is, wherein at least one aromatic nucleus is fused at two points to another nucleus as in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, carbonyl group containing linkages, sulfide linkages, polysulfide linkages of 2 to 6 sulfur atoms, sulfinyl linkages, sulfonyl linkages, methylene linkages, alkylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by one methylene linkage and one covalent bond. Such a nucleus may be considered to have 3 nuclei but only two of them are aromatic. More often, Ar will contain only carbon atoms in the aromatic nucleus per se. When Ar contains only carbon atoms in the aromatic nucleus, it will contain at least 6 carbon atoms.

Specific examples of single ring Ar moieties are the following:

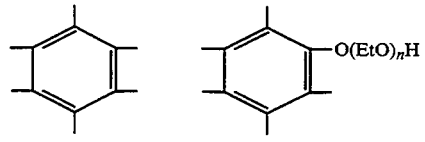

-continued

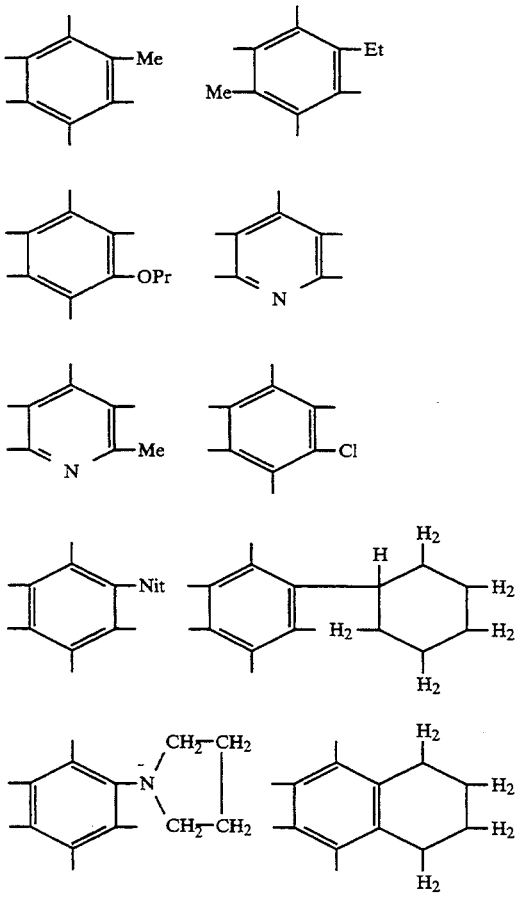

etc., wherein Me is methyl, Et is ethyl or ethylene, as appropriate, Pr is n-propyl, and Nit is nitro.

Specific examples of fused ring aromatic moieties Ar are:

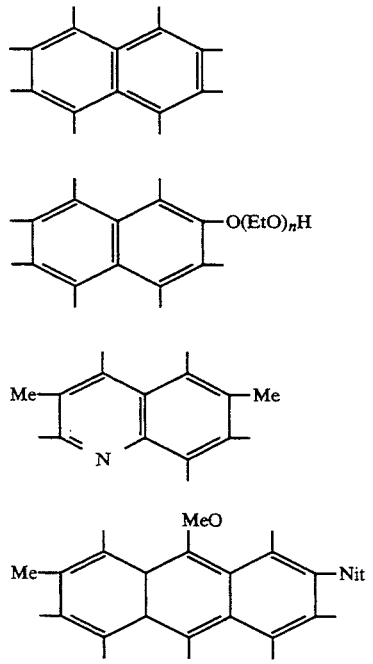

-continued

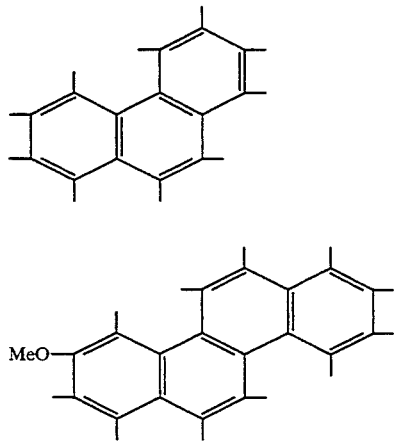

etc.

When the aromatic moiety Ar is a linked polynuclear aromatic moiety, it can be represented by the general formula $$ar\text{-}(L\text{-}ar)_w$$

wherein w is an integer of 1 to about 6, each ar is a single ring or a fused ring aromatic nucleus of 5 to about 12 carbon atoms and each L is independently selected from the group consisting of carbon-to-carbon single bonds between ar nuclei, ether linkages (e.g. —O—), keto linkages (e.g.

$$-\overset{O}{\overset{\|}{C}}-),$$

sulfide linkages (e.g. , —S—), polysulfide linkages (e.g. , $-S-_{2\text{-}6}$), sulfinyl linkages (e.g. , —S(O)—), sulfonyl linkages (e.g., $-S(O)_2-$) , lower alkylene linkages (e.g., $-CH_2-$, $-CH_2-CH_2-$, $-CR^\circ{}_2-$, $$-CH-\underset{\underset{R^\circ}{|}}{CH}-),$$

lower alkylene ether linkages (e.g., —CHO—, $-CH_2O-CH_2-$, $-CH_2-CH_2O-$, $-CH_2CH_2OCH_2CH_2-$, $$-CH_2\underset{\underset{R^\circ}{|}}{CHO}CH_2\underset{\underset{R^\circ}{|}}{CH}-,\quad -CH_2\underset{\underset{R^\circ}{|}}{CHO}\underset{\underset{R^\circ}{|}}{CH}CH_2-,$$

etc. ), lower alkylene sulfide linkages (e.g., wherein one or more —O—'s in the lower alkylene ether linkages is replaced with a S atom), lower alkylene polysulfide linkages (e.g., wherein one or more —O— is replaced with a $-S-_{2\text{-}6}$ group), amino linkages (e.g., $$-\underset{\underset{H}{|}}{N}-,\quad -\underset{\underset{R^\circ}{|}}{N}-,$$

$-CH_2N-$, $-CH_2NCH_2-$, —alk—N—, where alk is lower alkylene, etc.), polyamino linkages ( e.g., $-N-(alkN)_{1\text{-}10}$, where the unsatisfied free N valences are taken up with H atoms or R° groups), linkages having the formula

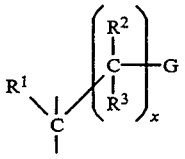

(II)

wherein each of $R^1$, $R^2$ and $R^3$ is independently H or hydrocarbyl, preferably H or alkyl or alkenyl, most preferably lower alkyl or H, each G is independently an amide or an amide-containing group, a carboxyl group, an ester group, an oxazoline-containing group or an imidazoline-containing group and x is an integer ranging from 0 to about 8, and mixtures of such bridging linkages (each R° being a lower alkyl group).

Specific examples of linked moieties are:

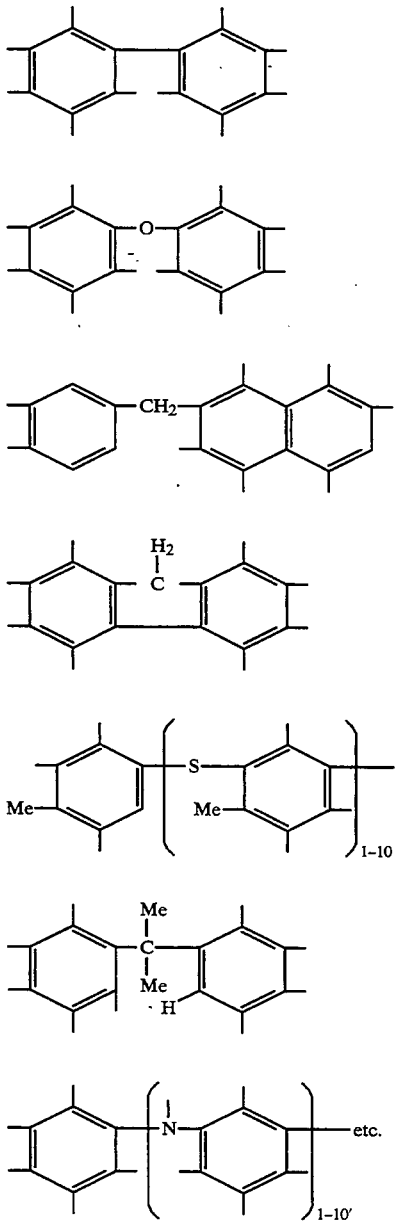

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus. Most preferably, Ar is a benzene nucleus.

The Group R

The compounds of formula (I) employed in the compositions of the present invention preferably contain, directly bonded to at least one aromatic group Ar, at least one group R which, independently, is a hydrocarbyl group. More than one hydrocarbyl group can be present, but usually no more than 2 or 3 hydrocarbyl groups are present for each aromatic nucleus in the aromatic group Ar.

The number of R groups on each Ar group is indicated by the subscript m. For the purposes of this invention, each m may be independently 0 or an integer ranging from 1 up to about 6 with the proviso that m does not exceed the number of valences of the corresponding Ar available for substitution. Frequently, each m is independently an integer ranging from 1 to about 3. In an especially preferred embodiment each m equals 1.

Each R frequently contains up to about 750 carbon atoms, more frequently from 4 to about 750 carbon atoms, preferably from 4 to about 400 carbon atoms and more preferably from 4 to about 100 carbons. R is preferably an aliphatic group, more preferably alkyl or alkenyl, preferably alkyl or substantially saturated alkenyl. In one preferred embodiment, R is aliphatic and contains at least about 6 carbon atoms, often from 8 to about 100 carbons. In another embodiment, each aliphatic R contains an average of at least about 30 carbon atoms, often an average of from about 30 to about 100 carbons. In another embodiment, R is aliphatic and contains from 12 to about 50 carbon atoms. In a further embodiment, R is aliphatic and contains from about 7 to about 28 carbon atoms, preferably from 12 to about 24 carbon atoms and more preferably from 12 to about 18 carbon atoms. In another preferred embodiment, R contains from about 16 to about 28 carbon atoms. In one embodiment, at least one R is derived from an alkane or alkene having number average molecular weight ranging from about 300 to about 800. In another embodiment, R is aliphatic and contains an average of at least about 50 carbon atoms. When R contains fewer than 16 carbon atoms, it is often preferred that R is substantially linear, that is, it contains no more than 3, preferably no more than one, most preferably, no branching group from the main chain. However, in one preferred embodiment m is 2, each Ar contains at least one tertiary-butyl group, and the other R group contains from 4 to about 100 carbon atoms, for example a 2,4-di-t-butyl phenol.

When the group R is an alkyl or alkenyl group having from 2 to about 28 carbon atoms, it is typically derived from the corresponding olefin; for example, a butyl group is derived from butene, an octyl group is derived from octene, etc. The corresponding olefin may be derived from lower olefins, e.g., a propylene tetramer, etc. When R is a hydrocarbyl group having at least about 30 carbon atoms, it is frequently an aliphatic group, preferably an alkyl or alkenyl group, made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-olefins. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene.

As used herein, the term "hydrocarbyl or hydrocarbyl group" denotes a group having a carbon atom directly attached to the remainder of the molecule and having predominantly hydrocarbon character within the context of this invention- Thus, the term "hydrocarbyl" includes hydrocarbon, as well as substantially hydrocarbon, groups. Substantially hydrocarbon describes groups, including hydrocarbon based groups, which contain non-hydrocarbon substituents, or non-carbon atoms in a ring or chain, which do not significantly alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic- substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon-containing substituents which, in the context of this invention, do not significantly alter the predominantly hydrocarbon character; those skilled in the art will be aware of such groups (e.g., hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Usually the hydrocarbyl groups are purely hydrocarbon and contain substantially no such non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present. In one especially preferred embodiment, the hydrocarbyl group R is substantially free of carbon to carbon unsaturation. It is to be understood that, within the context of this invention, aromatic unsaturation is not normally considered to be olefinic unsaturation. That is, aromatic groups are not considered as having carbon-to-carbon unsaturated bonds.

Preferably, hydrocarbyl groups R are substantially aliphatic in nature, that is, they contain no more than one non-aliphatic (cycloalkyl, cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. These purely aliphatic R groups are alkyl or alkenyl groups.

Specific non-limiting examples of substantially saturated hydrocarbyl R groups are: methyl, tetra (propylene), nonyl, triisobutyl, oleyl, tetracontanyl, henpentacontanyl, a mixture of poly(ethylene/propylene) groups of about 35 to about 70 carbon atoms, a mixture of the oxidatively or mechanically degraded poly(ethylene/propylene) groups of about 35 to about 70 carbon atoms, a mixture of poly (propylene/1-hexene) groups of about 80 to about 150 carbon atoms, a mixture of poly(isobutene) groups having between 20 and 32 carbon atoms, and a mixture of poly(isobutene) groups having an average of 50 to 75 carbon atoms. A preferred source of hydrocarbyl groups R are polybutenes obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

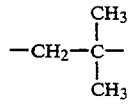

These polybutenes are typically monoolefinic. In one embodiment, the monoolefinic groups are vinylidene groups, i.e., groups of the formula

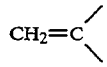

although the polybutenes may also comprise other olefinic configurations

In one embodiment the polybutene is substantially monoolefinic, comprising at least about 50% vinylidene groups, more preferably at least about 80% vinylidene groups.

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y., and U.S. Pat. Nos. 4,379,065; 4,663,063; and 4,708,809, all of which are expressly incorporated herein by reference for relevant disclosures regarding alkylation of aromatic compounds. Other equally appropriate and convenient techniques for attaching the hydrocarbon-based group R to the aromatic moiety Ar will occur readily to those skilled in the art.

The Groups Z

Each Z is independently OH, lower alkoxy, $(OR^5)_bOR^6$, or $O^-$ wherein each $R^5$ is independently a divalent hydrocarbyl group, $R^6$ is H or hydrocarbyl and b is a number ranging from 1 to about 30.

The subscript c indicates the number of Z groups that may be present as substituents on each Ar group. There will be at least one Z group substituent, and there may be more, depending on the value of the subscript m. For the purposes of this invention, c is a number ranging from 1 to about 3. In a preferred embodiment, c is 1.

As will be appreciated from the foregoing, the compounds of formula (I) employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH, lower alkoxy, $O^-$ or $(OR^5)_bOR^6$ as defined hereinabove. In a preferred embodiment, each Z is OH. In another embodiment, each Z may be $O^-$. In another preferred embodiment, at least one Z is OH and at least one Z is $O^-$. Alternatively, at least one Z may be a group of the formula $(OR^5)_bOR^6$, or lower alkoxy. As mentioned hereinabove each $R^5$ is independently a divalent hydrocarbyl group. Preferably, $R^5$ is an aromatic or an aliphatic divalent hydrocarbyl group. Most preferably, $R^5$ is an alkylene group containing from 2 to about 30 carbon atoms, more preferably from 2 to about 8 carbon atoms and most preferably 2 or 3 carbon atoms. $R^6$ is preferably H or alkyl, more preferably H or lower alkyl, that is, containing from 1 to about 7 carbon atoms.

The subscript b typically ranges from 1 to about 30, preferably from 1 to about 10, and most preferably from 1 or 2 to about 5.

The Groups $R^1$, $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to about 100 carbon atoms, more often from 1 to about 24 carbon atoms. In a preferred embodiment, each of the aforementioned groups is independently hydrogen or alkyl or an alkenyl group. In one preferred embodiment each of $R^1$, $R^2$ and $R^3$ is, independently, H or lower alkyl. In an especially preferred embodiment, each of the aforementioned groups is H. For the purposes of this invention, the term "lower" when used in the specification and claims to describe an alkyl or alkenyl group means from 1 to 7 carbon atoms.

The Group $R^4$ $R^4$ is a terminating substituent on an Ar group. As such $R^4$ may be H, hydrocarbyl or any of the groups defined hereinabove as substituents on Ar provided that said substituent is monovalent. Thus, $R^4$ may be any of the optional substituents on Ar referred to hereinabove, as well as R, Z or H. Most often, $R^4$ is H or a hydrocarbyl group, preferably H or lower alkyl, or lower alkenyl, most preferably, H.

The subscript y defines the number of

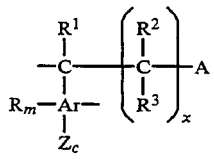

(III)

groups present in (I). The number y is at least one, usually a number ranging from 1 to about 10, more often from 1 to about 3, and preferably 1.

The subscript x denotes the number of

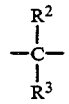

groups present. For the purposes of this invention, x normally ranges from 0 to about 8. In a preferred embodiment, x is 0, 1 or 2. Most preferably x equals 0.

The Group A

The compound of formula (I) contains at least one group A, wherein at least one A is an amide or an amide-containing group. When y=1, the compound of formula (I) contains one group A, and this one group A is an amide or an amide-containing group. When y is a number greater than 1, the compound of formula (I) contains more than one group A. In that case, at least one A is an amide or amide-containing group and the remaining groups may be amide or amide-containing groups, ester groups, carboxyl groups, acylamino groups, imidazoline-containing groups, oxazoline-containing groups or when one Z and A are taken together, a lactone group of the formula

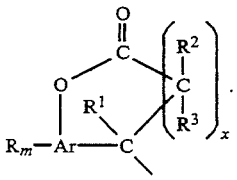

(IV)

Preferably each A is an amide or amide-containing group.

It is to be understood that compounds of formula (I) in mixtures comprising up to about 50% unreacted carboxylic acid groups or lactone are contemplated as being within the scope of this invention- Preferably, any mixture comprising the compound of formula (I) comprises no more than about 30% unreacted carboxylic acid groups or lactone, more preferably, no more than about 15% and even more preferably, no more than about 5% unreacted carboxylic acid or lactone.

In one embodiment at least one A has the general formula

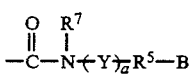

(V)

wherein each Y is a group of the formula

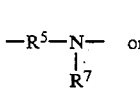

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hydroxyalkyl-substituted amino hydrocarbyl group, and B is an amide group, an imide-containing group, an amide-containing group or an acylamino group. The subscript a may be 0 or a number ranging from 1 to about 100. More typically, when Y is a group of the formula

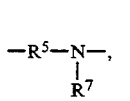

the subscript "a" ranges from 1 to about 10, more often from 1 to about 6. When Y is —$R^5$O—, the subscript a typically ranges from 1 to about 100, preferably from 10 to about 50.

Preferably, each $R^5$ is lower alkylene such as ethylene, propylene or butylene.

The groups B are preferably selected from acylamino groups of the formula

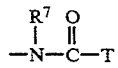

(VI)

wherein each $R^7$ is independently H, alkoxyalkyl, hydrocarbyl, aminohydrocarbyl or an N-alkoxyalkyl- or N-hydroxyalkyl-substituted amino hydrocarbyl group and T is hydrocarbyl, groups of the formula

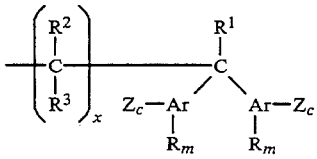

(VII)

wherein each component of this group is defined hereinabove, or imide-containing groups.

In another embodiment, at least one A has the formula

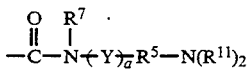

(VIII)

wherein each Y is a group of the formula

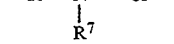

each $R^5$ is independently a divalent hydrocarbyl group, each $R^{11}$ is independently H, alkoxyalkyl, hydroxyalkyl or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is as defined hereinabove.

In a particularly preferred embodiment, A is a group of the formula

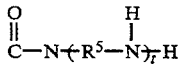

(X)

wherein $R^5$ is an ethylene, propylene or butylene group, most preferably ethylene, and t is a number ranging from 1 to about 4.

In still another embodiment at least one A has the formula

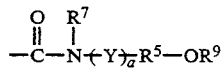

(IX)

wherein each Y is a group of the formula each $R^5$ is independently a divalent hydrocarbyl group, each $R^9$ is independently H or hydrocarbyl and each $R^7$ is H, alkoxyalkyl, hydroxyalkyl, a hydrocarbyl group, an aminohydrocarbyl group, or an N-alkoxyalkyl- or hydroxyalkyl-substituted aminohydrocarbyl group and a is as defined hereinabove.

In one preferred embodiment at least one, and more preferably each, Ar in formula (I) has the formula

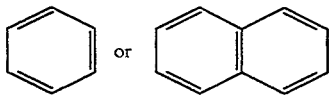

In another preferred embodiment at least one Ar is a linked aromatic group corresponding to the formula $$ar\text{-}(L\text{-}ar)_w$$

wherein each element of the formula is as described hereinabove. Preferably each ar is independently a benzene nucleus or a naphthalene nucleus, most preferably a benzene nucleus.

In one particularly preferred embodiment, at least one Ar is a member of the group consisting of a benzene nucleus, a lower alkylene bridged, preferably methylene bridged, benzene nucleus or a naphthalene nucleus.

Most preferably each Ar is a benzene nucleus.

In one particularly preferred embodiment at least one Z is —OH or $(OR^5)_bOR^6$, more preferably —OH. Especially preferred is where each Z is —OH.

In another preferred embodiment, each Z is OH, m and c are each one, x=0, Ar has no optional substituents and $R^1$=H.

In an especially preferred embodiment, each Ar is

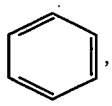

$R^1$ is H or alkyl or alkenyl containing from 1 to about 20 carbon atoms, each R is a hydrocarbyl group containing from 4 to about 300 carbon atoms, preferably from 7 to about 100 carbon atoms, and A is an amide or amide-containing group. Preferably R is alkyl or substantially saturated alkenyl.

With respect to this especially preferred embodiment at least one A is the group of the formula $$-\overset{O}{\overset{\|}{C}}-N\text{-}(R^5-\overset{H}{\overset{|}{N}})_t\text{-}H \qquad (X)$$

wherein $R^5$ is an ethylene, propylene or butylene group, and t is a number ranging from 1 to about 4.

The products of formula (I) employed as additives in the fuel compositions of this invention may be readily prepared by reacting (a) reactants of the formula $$R_m-\underset{\underset{(H)_s}{|}}{Ar}-Z_c \qquad (XI)$$

wherein R is a hydrocarbyl group as defined hereinabove, m ranges from 0 to about 6, preferably 1 or 2, most preferably 1, Ar is an aromatic group containing from 5 to about 30 carbon atoms having from 0 to 3 optional substituents selected from the group described hereinabove, wherein s is an integer of at least 1 and c ranges from 1 to about 3, wherein the total of s+m+c does not exceed the number of valences of Ar available for substitution and Z is as defined hereinabove with (b) a carboxylic reactant of the formula $$R^1CO(CR^2R^3)_xCOOR^{10} \qquad (XII)$$

wherein $R^1$, $R^2$ and $R^3$ are independently H or a hydrocarbyl group, $R^{10}$ is H or an alkyl group, and x is an integer ranging from 0 to about 8 and then reacting the intermediate so formed with ammonia or an amine, as described in greater detail hereinbelow, to form an amide.

When $R^1$ is H, the aldehyde moiety of reactant (XII) may be hydrated. For example, glyoxylic acid is readily available commercially as the hydrate having the formula $$HCOCO_2H\cdot H_2O$$

Glyoxylic acid monohydrate is the preferred reactant and is readily available commercially, for example from Hoechst-Celanese, Aldrich Chemical and Chemie-Linz.

Water of hydration as well as any water generated by the condensation reaction is preferably removed during the course of the reaction.

Ranges of values and descriptions of the groups and subscripts appearing in the above formulae (XI) and (XII) are the same as recited hereinabove for formulae ( I ) and (II). When $R^6$ is an alkyl group it is preferably a lower alkyl group, most preferably, ethyl or methyl.

The reaction to form the intermediate is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ratio of about 2: 1; however, useful products may be obtained by employing an excess amount of either reactant. Thus, molar ratios of (a): (b) of 1:1, 2:1, 1:2, 3:1, etc. are contemplated and useful products may be obtained thereby. Illustrative examples of reactants (a) of formula (XI) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the Z groups may be s ingle ring, fused ring or linked aromatic groups as described in greater detail hereinabove.

Specific illustrative examples of compound (XI) employed in the preparation of compounds of formula (I) include phenol, naphthol, 2,2 '-dihydroxybiphenyl, 4,4-dihydroxybiphenyl 3 -hydroxyanthracene, 1,2,10-anthracenetriol, resorcinol, 2-t-butyl phenol, 4-t-butyl phenol, 2-t-butyl alkyl phenols, 2,6-di-t-butyl phenol, octyl phenol, cresols, propylene tetramer-substituted phenol, propylene oligomer (MW 300–800)-substituted phenol, polybutene ($M_n$ about 1000)-substituted phenol substituted naphthols corresponding to the above exemplified phenols, methylene-bis-phenol, bis-(4-hydroxyphenyl)-2,2-propane, and hydrocarbon substituted bisphenols wherein the hydrocarbon substituents are, for example, methyl, butyl, heptyl, oleyl, polybutenyl, etc., sulfide-and polysulfide-linked analogues of any of the above, alkoxylated derivatives of any of the above hydroxy aromatic compounds, etc. Preferred compounds of formula (XI) are those that will lead to preferred compounds of formula (I). Especially preferred are para-alkylsubstituted phenols.

The method of preparation of numerous alkyl phenols is well-known. Illustrative examples of alkyl phenols and related aromatic compounds and methods for preparing same are give in U.S. Pat. No. 4,740,321 to Davis et al. This patent is hereby incorporated herein by reference for relevant disclosures contained therein.

Non-limiting examples of the carboxylic reactant (b) of formula (XII) include glyoxylic acid and other omega-oxoalkanoic acids, keto alkanoic acids such as pyruvic acid, levulinic acid, ketovaleric acids, ketobutyric acids and numerous others. The skilled worker, having the disclosure before him, will readily recognize the appropriate compound of formula (XII) to employ as a reactant to generate a given intermediate. Preferred compounds of formula (XII) are those that will lead to preferred compounds of formula (I).

U.S. Pat. No. 2,933,520 (Bader) and 3,954,808 (Elliott et al) describe procedures for preparing the intermediate via reaction of phenol and acid. These patents are expressly incorporated herein for relevant disclosures contained therein.

The intermediate product obtained from the reaction of the foregoing hydroxy aromatic compounds and carboxylic acids is then reacted with an amine. Suitable amine reactants will be described hereinbelow.

Ammonia tends to resist reaction with the lactone-containing intermediate but generally will react with the carboxylic-acid containing intermediate.

Examples of reactants are intended to be illustrative of suitable reactants and are not intended to be, and should not be viewed as, an exhaustive listing thereof.

The intermediate arising from the reaction of (a) and (b) may be a carboxylic acid or a lactone, depending upon the nature of (a). In particular, when (a) is a highly hindered hydroxy aromatic compound, the product from (a) and (b) is often a carboxylic acid. When the hydroxy aromatic reactant (a) is less hindered, a lactone is generated. Para-substituted phenols usually result in lactone formation.

Often, the intermediate arising from the reaction of (a) and (b) is a mixture comprising both lactone and carboxylic acid.

It will be appreciated that the reaction of reactants (a) and (b) will lead to a compound containing a group Z, as described hereinabove except that when the product is a lactone, Z may be absent.

Amine Reactants

Suitable amines, as defined herein, include ammonia, monoamines or polyamines. The monoamines generally contain from 1 to about 24 carbon atoms, preferably 1 to about 12, and more preferably 1 to about 6. Examples of monoamines useful in the present invention include primary amines, for example methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary monoamines will not result in formation of an amide.

In another embodiment, the monoamine may be a hydroxy-amine. Typically, the hydroxyamines are primary or secondary alkanolamines or mixtures thereof. As stated above, tertiary monoamines will not react to form amides; however tertiary alkanol monoamines sometimes can react to form a tertiary amino group containing ester. They tend to resist reaction with the lactone intermediate. However, when the intermediate contains carboxylic acid groups, reaction with the —OH group of alkanolamines can lead to ester formation. Alkanol amines that can react to form amide can be represented, for example, by the formulae:

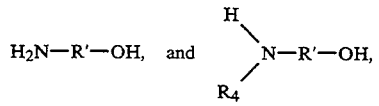

wherein each $R_4$ is independently a hydrocarbyl group of one to about 22 carbon atoms or hydroxyhydrocarbyl group of two to about 22 carbon atoms, preferably one to about four, and R′ is a divalent hydrocarbyl group of about two to about 18 carbon atoms, preferably two to about four. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2 -propylene, 1,2 -butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N- (hydroxyl lower alkyl) -morpholines, -thiomorpholines, -piperidines, -oxazolidines, -thiazolidines and the like. Typically, however, each $R^4$ is independently a methyl, ethyl, propyl, butyl, pentyl or hexyl group.

Examples of these alkanolamines include mono-, di-, and triethanolamine, diethylethanolamine, ethylethanolamine, butyldiethanolamine, etc.

The hydroxyamines can also be ether N-(hydroxyhydrocarbyl) amines. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

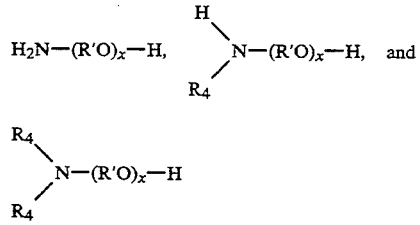

wherein x is a number from about 2 to about 15 and $R_4$ and R′ are as described above. $R_4$ may also be a hydroxypoly(hydrocarbyloxy) group.

Other useful amines include ether amines of the general formula $$R_6OR^1NHR_7$$

wherein $R_6$ is a hydrocarbyl group, preferably an aliphatic group, more preferably an alkyl group, containing from 1 to about 24 carbon atoms, $R^1$ is a divalent hydrocarbyl group, preferably an alkylene group, containing from two to about 18 carbon atoms, more preferably two to about 4 carbon atoms and $R_7$ is H or hydrocarbyl, preferably H or aliphatic, more preferably H or alkyl, more preferably H. When $R_7$ is not H, then it preferably is alkyl containing from one to about 24 carbon atoms. Especially preferred ether amines are those available under the name SURFAM produced and marketed by Mars Chemical Co., Atlanta, Georgia.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

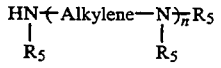

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently hydrogen or an aliphatic or hydroxy-substituted aliphatic group of up to about 30 carbon atoms. Preferably $R_5$ is H or lower alkyl, most preferably, H.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas, designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris(hydroxymethyl)aminomethane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated by reference for its disclosure to the condensates and methods of making.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-di-(2-hydroxyethyl)-ethylenediamine, 1-(2-hydroxyethyl)-piperazine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylmorpholines, N-aminoalkylthiomorpholines, N-aminoalkylpiperazines, N,N'-bis-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy alkyl substituted heterocyclic polyamines are also useful. Examples include N-hydroxyethylpiperazine and the like.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybuteneamine;N-Polybutene-aniline; N-polybutenemorpholine; N-poly(butene)ethylenediamine; N-poly(propylene)trimethylenediamine; N-poly(butene)diethylenetriamine;N',N'-poly(butene)tetraethylenepentamine;N,N-dimethyl-N'-poly(propylene)-1,3-propylenediamine and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an $\overline{M}n$ (number average molecular weight) value of at least about 500. Generally, the polyalkene substituted amine is characterized by an $\overline{M}n$ value of about 500 to about 5000, preferably about 800 to about 2500. In another embodiment $\overline{M}n$ varies between about 500 to about 1200 or 1300.

The polyalkenes from which the polyalkene substituted amines are derived include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

The amide forms by reaction of the amine with the lactone intermediate, opening the lactone ring, forming an amide, or from direct reaction with a carboxylic acid group. It is generally preferred to utilize sufficient amine reactant to convert substantially all of the carboxylic acid or lactone to amide; however, conversion of at least 50%, more preferably 75% of lactone or carboxylic acid to amide is often acceptable. Preferably, at least 90%, more preferably 99-100% conversion of lactone or carboxylic acid to amide is effected.

The reaction of the lactone or carboxylic acid with an amine to prepare the amides of this invention is conducted at temperatures ranging from about 25° C. to about 230° C., preferably 60° C.-150° C., more preferably 100°-110° C. Under certain conditions, imidazoline or oxazoline formation may occur. These are frequently obtained by first preparing the amide then continuing the reaction at elevated temperature to generate imidazoline or oxazoline.

Imidazoline formation will not occur with every amine; the amine must have the structural element:

$$H_2NCR_2^fCR_2^f—NH—R^f.$$

Similarly, oxazoline formation can take place when the amine is a $\beta$-hydroxyethyl amine, e.g., $$HO—CR_2^fCR_2^f—NH_2$$

In the above formulae, each $R^f$ is independently H, alkoxyalkyl, hydroxyalkyl, hydrocarbyl, aminohydrocarbyl or N-alkoxyalkyl- or hydroxyalkyl- substituted amino hydrocarbyl.

Thus, if imidazoline or oxazoline formation is not desired, they may be avoided by employing amine reactants that do not provide the opportunity for imidazoline or oxazoline formation, or, if the amine employed can lead to oxazoline or imidazoline, to minimize formation thereof by conducting the reaction at the lowest temperature to prepare amide at an acceptable rate and in acceptable amounts, or to avoid prolonged heating of the amide-containing product, once it has formed. Infrared analysis during the reaction is a convenient means for determining the nature and extent of the reaction.

The following specific illustrative examples describe the preparation of the compounds of formula (I) useful in the fuel compositions of this invention. In the following examples, as well as in the claims and in the specification of this application, unless otherwise indicated, parts are parts by weight, the temperature is degrees Celsius and the pressure is atmospheric. Where numerical values of pressure are given they are expressed in millimeters mercury pressure and in kiloPascal (kPa). In several examples, amounts of liquids are given as parts by volume. In those examples, the relationship between parts by weight and parts by volume is as grams and milliliters.

As will be readily apparent to those skilled in the art, variations of each of the illustrated reactants and combination of reactants and conditions may be used.

EXAMPLE 1

A mixture is prepared by combining 2300 parts of a polybutene-substituted phenol prepared by boron trifluoride-phenol catalyzed alkylation of phenol with a polybutene having a number average molecular weight of approximately 1000 (vapor phase osmometry-VPO), 151.1 parts 50 percent aqueous glyoxylic acid (Hoechst Celanese) and 1.15 parts 70 percent aqueous methanesulfonic acid in a reactor equipped with a stirrer, thermowell, subsurface gas inlet tube and a Dean-Stark trap with a reflux condenser for water removal. The mixture is heated to 125° C. under a nitrogen sweep, water is collected in the Dean-Stark trap at 125°-135° C. for 1.5 hours, the temperature is increased over 0.5 hours to 158° C. and held there for 2.5 hours, continuing water collection in the Dean-Stark trap. A total of 103 parts by volume water is collected.

To the above mixture is charged 814.3 parts of aromatic hydrocarbon solvent (HI-SOL 10, Ashland Chemical Company), while the reaction mixture cools from 158° C. to 121° C. in 0.25 hours. Cooling is continued over 1.75 hours to 44° C.

To the cooled solution is added 105.2 parts diethylenetriamine (Aldrich) which is accompanied by an exothermic reaction from 44° C. to 55° C. over 8 minutes. The reaction mixture is heated over 0.5 hours to 115° C. and is held there for 1 hour. Infrared analysis at this point shows no lactone carbonyl remaining at 1785 $cm^{-1}$, and the appearance of an amide carbonyl at 1643 $cm^{-1}$.

The reaction is vacuum filtered at 110°-115° C., at no less than 100 millimeters mercury pressure (13.3 kPa), employing a diatomaceous earth filter aid. The filtrate contains, by analysis, 1.31 percent nitrogen, and has a neutralization number (basic) of 32.5. Gel permeation chromatography shows a peak molecular weight (77.5 percent) of 2495.

EXAMPLE 2

To a reactor equipped as described in Example 1, are charged 5498 parts of a polybutene substituted phenol similar to that described in Example 1 and containing 1.51 percent OH, 361 parts 50 percent aqueous glyoxylic acid (Aldrich) and 3.7 parts paratoluene sulfonic acid monohydrate (Eastman). The materials are heated under nitrogen to 150° C. and held at 150°-160° C. for 7 hours, collecting 245 parts by volume water in the Dean-Stark trap. The reaction product is filtered at 140°-150° C. employing a diatomaceous earth filter aid. Gel permeation chromatography (GPC) shows 100 percent centered at 3022 molecular weight.

To another reactor equipped as above are charged 1200 parts of the above reaction product and 54 parts diethylene triamine (Union Carbide). The materials are heated under nitrogen to 110° C. and held at 110°-120° C. for 8 hours, collecting additional distillate in the Dean-Stark trap. The materials are cooled at which time 413 parts toluene are added. The product is vacuum filtered at 120 millimeters mercury pressure (16 kPa) employing a diatomaceous earth filter aid.

EXAMPLE 3

An intermediate is prepared by reacting at 145°-150° C. for 10 hours 2215 parts of the polybutene-substituted phenol described in Example 2 and 137 parts 50 percent aqueous glyoxylic acid (Aldrich) in the presence of 1.5 parts paratoluene sulfonic acid for a period of 10 hours, collecting 91 parts water in a Dean-Stark trap. The saponification number (KOH) of this product is 25.3.

To a reactor are charged 1145 parts of the foregoing reaction product and 36.5 parts of a mixture of commercial ethylene polyamines having from 3 to about 10 nitrogen atoms per molecule and a nitrogen content of about 35 percent. The materials are heated under nitrogen to 155° C. and held at 155°-160° C. for 8 hours, collecting 3.3 parts water in a Dean-Stark trap. Xylene (495 parts) is added and the solution is vacuum filtered employing a diatomaceous earth filter aid. The liltrate contains, by analysis, 0.77 percent nitrogen and has a neutralization number (basic) of 11.9. GPC analysis of the solution shows 67.6 percent has molecular weight of 3209 and 32.4 percent is the xylene solvent.

EXAMPLE 4

The process of Example 3 is repeated employing 1050 parts of the polybutene-substituted phenol-glyoxylic acid reaction product, 20.9 parts of the amine mixture and 356 parts xylene. The xylene solution contains, by analysis, 0.52 percent nitrogen and has a neutralization number (basic) of 6.1. GPC analysis shows 73.3 percent has a molecular weight of 3256 and 26.7 percent is xylene solvent.

EXAMPLE 5

To a reactor are charged 2401 parts of polybutene-substituted phenol, 157.8 parts glyoxylic acid, each as described in Example 2, and 1.2 parts 70 percent aqueous methanesulfonic acid. The materials are heated under nitrogen over 3 hours to 155° C. and held at 155°-160° C. for 3 hours, collecting a total of 102 parts water, followed by addition of 857 parts of the aromatic hydrocarbon solvent described in Example 1. The solution is cooled to 27° C. followed by addition, all at one time, of ethylene polyamine bottoms identified as HPA-X (Union Carbide) having an equivalent weight of 118.8 per primary amine, exotherming over 5 minutes to 39° C. The reaction is heated to 115° C. over 1 hour and held at 115°-120° C. for 4 hours. The materials are filtered employing a diatomaceous earth filter aid at 110°-120° C. at a pressure no less than 100 millimeters mercury (13.3 kPa).

EXAMPLE 6

The process of Example 5 is repeated employing 2222 parts of the polybutene substituted phenol and 146 parts of the 50 percent aqueous glyoxylic acid described in Example 2, 1.5 parts paratoluene sulfonic acid monohydrate and 600 parts by volume xylene. The materials are heated under nitrogen at reflux (170° C. maximum) for 7 hours, collecting 103 parts water in a Dean-Stark trap. The materials are cooled to 25° C., followed by addition of 208.5 parts of the amine described in Example 5, which has an equivalent weight, per nitrogen, of 40.5. Following refluxing at 170° C. maximum for 6 hours, while collecting 16 parts water, the materials are vacuum stripped to 170° C. over 3 hours, 1666 parts mineral oil diluent are added and the oil solution is filtered employing a diatomaceous earth filter aid at 140°-150° C. The oil solution has a nitrogen content, by analysis, of 1.61% and a neutralization number (basic) of 39.6.

EXAMPLE 7

Following the general procedure described in the foregoing examples, 3105 parts of polybutene-substituted phenol and 204 parts 50 percent aqueous glyoxylic acid (Aldrich) are reacted under nitrogen in the presence of 2.1 parts paratoluene sulfonic acid monohydrate (Eastman) at 150°-160° C. for 10 hours, collecting a total of 131 parts water. The materials are filtered employing a diatomaceous earth filter aid.

To another reactor are charged 368 parts of the foregoing reaction product and 16.4 parts of N,N-dimethyl-1,3-propanediamine (Eastman) followed by heating at 125°-130° C. for 7 hours. Infrared analysis shows no lactone remaining after the heating period. To the reaction product are added 128 parts toluene, the solution is stirred thoroughly at 95°–100° C. and collected. The solution has, by analysis, 0.87 percent nitrogen.

EXAMPLE 8

To a reactor are charged 308 parts of the polybutene-substituted phenol-glyoxylic acid reaction product of Example 7 and 9.82 parts of triethylenetetramine. The materials are heated under nitrogen at 120°–130° C. for 7 hours at which time no lactone carbonyl remains by infrared analysis. Xylene (106 parts) is added and the materials are stirred thoroughly at 90°–100° C. and collected. The xylene solution contains, by analysis, 0.86 percent nitrogen.

EXAMPLE 9

To a reactor equipped as described in Example 1 are charged 1350 parts of polybutene-substituted phenol and 89 parts 50 percent aqueous glyoxylic acid as described in Example 2, 0.9 parts paratoluene sulfonic acid monohydrate (Eastman) and 400 parts by volume xylene, followed by heating under nitrogen at reflux (maximum temperature 170° C.) for 5 hours while collecting 63 parts water in a Dean-Stark trap. The reaction mixture is cooled, 125.4 parts tetraethylenepentylamine are added and the materials are again heated at reflux (maximum temperature 170° C.) for 6 hours collecting 12 parts water in the Dean-Stark trap. Solvent is removed by stripping to 150° C. at 30 millimeters mercury (4 kPa) over 4 hours followed by addition of 1002 parts mineral oil diluent, and filtration at 120°–130° C. employing a diatomaceous earth filter aid. The filtrate contains, by analysis, 1.67 percent nitrogen.

EXAMPLE 10

To a reactor are charged 350 parts of the polybutene-substituted phenol-glyoxylic acid reaction product described in Example 2, 23 parts trishydroxymethylaminomethane (Kodak) and 200 parts by volume xylene. The materials are heated under nitrogen at 140°–150° C. for 10 hours while collecting 0.5 parts water in a Dean-Stark trap. Xylene is removed by vacuum stripping to 150° C. at 30 millimeters mercury (4 kPa) over 3 hours, mineral oil diluent (158 parts) is added and the oil solution is filtered at 130°–140° C. employing a diatomaceous earth filter aid. The liltrate contains, by analysis, 0.40 percent nitrogen.

EXAMPLE 11

Following essentially the procedures of the foregoing examples, 3210 parts polybutene-substituted phenol and 211 parts 50 percent aqueous glyoxylic acid, both as described in Example 2, are reacted at 165°–170° C. in the presence of 2.2 parts paratoluene sulfonic acid monohydrate while removing 148 parts water. The saponification number of this material is 24.4.

To another reactor are charged 450 parts of the foregoing reaction product, and 118 parts of a polyalkoxy alkyl primary amine having an equivalent weight of about 600 (Jeffamine M-600, Texaco Chemical Co.). Following heating under nitrogen at 125°–135° C. for 7 hours, infrared analysis shows no lactone remains. The product is diluted with 189.3 parts xylene and filtered at 120° C. and a pressure not less than 100 millimeters mercury (13.3 kPa) employing a diatomaceous earth filter aid. The filtrate solution contains, by analysis, 0.41 percent nitrogen.

EXAMPLE 12

A reactor is charged with 350 parts of the polybutene-substituted phenol-glyoxylic acid reaction product described in Example 7 and 19.72 parts of N-(2-aminoethylpiperazine (Union Carbide). The materials are reacted under nitrogen at 125°–130° C. for 6 hours at which time the infrared shows no lactone remains. Xylene, 123.2 parts is added, the materials are stirred at 100°–110° C. to affect solution and the solution is collected. The product contains, by analysis, 1.24 percent nitrogen.

EXAMPLE 13

A reactor equipped as described in Example 1 is charged with 2070 parts of a $C_{24-28}$ alkyl substituted phenol prepared by the acid catalyzed alkylation of phenol with a $C_{24-28}$ alphaolefin mixture, 316 parts 50 percent aqueous glyoxylic acid (Aldrich), 4 parts paratoluene sulfonic acid (Eastman) and 700 parts by volume of xylene, heated under nitrogen at 160°–170° C. for 7 hours, removing 217 parts water followed by vacuum stripping to 140° C. at 30 millimeters mercury pressure (4 Kpa) over 4 hours. The residue is filtered at 130°–140° C. employing a diatomaceous earth filter aid.

Another reactor is charged with 400 parts of the foregoing product and 48.9 parts of aminoethylpiperazine (Union Carbide). The materials are heated under nitrogen at 125°–130° C. for 6 hours at which time the infrared analysis shows no remaining lactone. The product is filtered at 125°–130° C. employing a diatomaceous earth filter aid. The filtrate contains, by analysis, 3.41 percent nitrogen and the infrared shows amide carbonyl absorption.

EXAMPLE 14

A reactor is charged with 2849 parts of a polypropylene-substituted phenol prepared by alkylation of phenol with a polypropylene having a molecular weight of about 400 in the presence of a boron trifluoride-ether catalyst, 415 parts of 50 percent aqueous glyoxylic acid (Aldrich) and 4 parts of paratoluene sulfonic acid monohydrate (Eastman). The reactants are heated to 155° C. over 3 hours and heating is continued at 155°–160° C. for 4 hours during which time 278 parts water is collected. The product obtained has a saponification number of 54.7.

Another reactor is charged with 600 parts of the foregoing product and 73.3 parts of N-aminoethylpiperazine (Union Carbide). The materials are heated under nitrogen at 110°–120° C. for 3 hours after which time infrared analysis shows no lactone remains. The materials are diluted with 224.3 parts xylene then vacuum filtered at 110°–120° C. at a pressure not less than 100 millimeters mercury (13.3 kPa) employing a diatomaceous earth filter aid. The filtrate contains, by analysis, 2.67 percent nitrogen.

EXAMPLE 15

A reactor is charged with 1976 parts of a propylene tetramer-substituted phenol prepared by alkylation of phenol with a propylene tetramer in the presence of a sulfonated polystyrene catalyst (Amberlyst 15, Rohm & Haas Co.), 558 parts of 50 percent aqueous glyoxylic acid (Aldrich) and 3 parts paratoluene sulfonic acid monohydrate. The materials are heated under nitrogen at 160°–170° C. over 8 hours while collecting 375 parts water. The materials are filtered employing a diatomaceous earth filter aid.

To another reactor are charged 300 parts of the foregoing product and 68.9 parts of N-aminoethylpiperazine (Union Carbide). The materials are reacted under nitrogen at 125°-130° C. for 6 hours after which time the infrared shows no lactone carbonyl remains at 1790 $cm^{-1}$. Toluene diluent is added, solution is effected by heating at 100°-110° C. for 2 hours and the materials are collected. The solution contains, by analysis, 4.43 percent nitrogen.

EXAMPLE 16

To a reactor equipped as described in Example 1 are charged 5250 parts of a polypropylene alkylated phenol prepared by alkylating phenol with a polypropylene having an average molecular weight of about 840 (Amoco Chemicals) in the presence of a boron trifluoride catalyst, 377 parts of 50 percent aqueous glyoxylic acid (Aldrich) and 2.9 parts 70 percent aqueous methane sulfonic acid. The materials are reacted under nitrogen by heating to 160° C. over 3 hours and holding at that temperature for 3 additional hours while collecting 240 parts water.

To another reactor are charged 2531 parts of the foregoing product, 156 parts N-aminoethylpiperazine (Union Carbide) and 896 parts of the aromatic hydrocarbon solvent described in Example 1. The materials are reacted under nitrogen at 120°-125° C. for 3 hours at which time the infrared analysis shows no lactone carbonyl remains. The materials are filtered employing a diatomaceous earth filter aid at 110°-115° C. and a pressure not less than 100 millimeters mercury (13.3 kPa). The filtrate contains, by analysis, 1.48 percent nitrogen.

EXAMPLE 17

To a reactor as described in Example 1 are charged 300 parts of the polyisobutene-substituted phenol-glyoxylic acid reaction product described in Example 2, 13.6 parts of aminoethylethanolamine and 70 parts by volume toluene. The materials are heated under nitrogen to 115° C. and held at 115°-125° C. for 4 hours while collecting water in a Dean-Stark trap. The materials are cooled then vacuum stripped to 100° C. at 25 millimeters mercury pressure (3.3 kPa) over 3 hours. Xylene, 103.3 parts is added to the residue, mixed thoroughly and the product is vacuum filtered warm at 120 millimeters mercury pressure (16 kPa) employing a diatomaceous earth filter aid.

EXAMPLE 18

A reactor is charged with 350 parts of the polypropylene-substituted phenol-glyoxylic acid reaction product of Example 15 and 75.3 parts of tris-hydroxymethylaminomethane, the materials are heated to 135° C. and held at 135°-140° C. for 10 hours. Xylene is added and the materials are stirred at 100°-110° C. for 2 hours followed by filtration at about 100° C. employing a diatomaceous earth filter aid. The filtrate contains, by analysis, 1.27 percent nitrogen.

EXAMPLE 19

To a reactor as described in Example 1 are charged 3371 parts of a polybutene-substituted phenol having an equivalent weight based on percent OH of 1126, 221.3 parts 50% aqueous glyoxylic acid and 1.7 parts 70 percent aqueous methane sulfonic acid. The materials are heated to 115°-120° C. at which point water evolution begins. The materials are heated to 160° C. and held at that temperature for 2.5 hours while collecting a total of 148 parts water. The materials are filtered employing a diatomaceous earth filter aid and collected.

Another reactor is charged with 425 parts of the foregoing reaction product, 26.7 parts N-aminopropylmorpholine and 150.6 parts of aromatic hydrocarbon solvent. The materials are heated under nitrogen at 115°-120° C. for 3 hours after which time the infrared analysis shows no lactone carbonyl remains. The product is filtered employing a diatomaceous earth filter aid at 115°-120° C. The filtrate contains, by analysis, 0.83 percent nitrogen and the infrared spectrum shows amide carbonyl.

EXAMPLE 20

A reactor is charged with 350 parts of the alkylated phenol-glyoxylic acid reaction product described in Example 13 and 33.8 parts of N,N-dimethyl-1,3-propanediamine (Eastman) followed by heating under nitrogen to 125° C. The materials are heated at 125°-135° C. for 7 hours; infrared analysis at this point shows no lactone remains unreacted. The materials are filtered employing diatomaceous earth filter aid at 125°-135° C. The filtrate contains, by analysis, 2.08 percent nitrogen.

EXAMPLE 21

A reactor is charged with 1552 parts of a polybutene-substituted phenol as described in Example 1, 1338 parts of the $C_{24-28}$ phenol described in Example 13, 306 parts 50 percent aqueous glyoxylic acid (Aldrich), 3 parts paratoluene sulfonic acid monohydrate (Eastman) and 600 parts by volume xylene solvent. The materials are heated under nitrogen to reflux and held at reflux (maximum temperature 180° C.) for 12 hours while collecting 213 parts water in a Dean-Stark trap. The materials are vacuum stripped to 150° C. and 30 millimeters mercury pressure over 3 hours and filtered at 140°-150° C. employing a diatomaceous earth filter aid.

Another reactor is charged with 400 parts of the foregoing reaction product and 31 parts of N,N-dimethyl-1,3-propanediamine (Eastman) followed by heating under nitrogen at 125°-130° C. for 7 hours. The product is filtered employing diatomaceous earth filter aid at about 125° C. The residue contains, by analysis, 1.62 percent nitrogen and the infrared shows amide carbonyl is present and lactone carbonyl is absent.

EXAMPLE 22

A reactor is charged with 750 parts of the alkylated phenol-glyoxylic reaction product described in Example 21 and 41.6 parts of triethylene tetramine followed by heating under nitrogen at 130°-135° C. for 8 hours. At this point the infrared spectrum shows no lactone remains. The materials are filtered employing a diatomaceous earth filter aid at 135°-140° C. The filtrate contains, by analysis, 1.83 percent nitrogen.

EXAMPLE 23

A reactor is charged with 3000 parts of the $C_{24-28}$ alkylated phenol described in Example 13, 457 parts of 50 percent aqueous glyoxylic acid (Hoechst Celanese) and 4.2 parts 70 percent aqueous methane sulfonic acid followed by heating under nitrogen to 125° C. over 0.5 hours. The materials are held at 125°-130° C. for 2 hours, collecting water in a Dean-Stark trap. The temperature is increased over 0.3 hours to 150° C. and is held at that temperature for 3 hours; a total of 302 parts water is collected. The reaction is cooled to 120°–125° C. and filtered employing a diatomaceous earth filter aid.

Another reactor is charged with 406 parts of the foregoing reaction product. At 60° C. under nitrogen, 229.3 parts of polyoxyethylene-oxypropylene-diamine (Jeffamine ED600, Texaco Chemicals) are added over 0.2 hours while the temperature rises exothermically to 65° C. The reaction temperature is increased to 150° C. over 0.5 hours and is held there for 3 hours. The materials are filtered employing a diatomaceous earth filter aid. The infrared analysis shows the presence of amide and the absence of lactone. The product contains, by analysis, 1.52 percent nitrogen.

EXAMPLE 24

To a reactor are charged 1942.8 parts of the $C_{24-28}$ alkylated phenol described in Example 13, 1048 parts of the tetrapropylene-substituted phenol described in Example 18, 592 parts of the 50 percent aqueous glyoxylic acid as described in Example 23 and 5.5 parts of 70 percent aqueous methane sulfonic acid. The materials are heated under nitrogen to 125° C. over 0.5 hours and are held at that temperature for 2 hours. Water is collected employing a Dean-Stark trap. The temperature is increased to 151° C. over 0.5 hours and held at that temperature for 3 hours while collecting additional water in the Dean-Stark trap. The materials are cooled to 125° C. and filtered employing a diatomaceous earth filter aid. The saponification number of the residue is 74.9. The residue contains, by analysis, 2.17 percent OH.

To another reactor is charged 393 parts of the foregoing reaction product which is then heated to 60° C. under a nitrogen blanket. Over 0.2 hours 285 parts of the amine described in Example 23 are added while the temperature rises exothermically to 71° C. The temperature is increased to 150° C. over 0.5 hours and held at that temperature for 3 hours. The product contains, by analysis, 1.86 percent nitrogen. Infrared analysis shows the presence of amide carbonyl.

EXAMPLE 25

A reactor is charged with 1360 parts nonylphenol, 457 parts 50 percent aqueous glyoxylic acid (Aldrich) and 1.8 parts 70 percent aqueous methane sulfonic acid. The materials are heated under nitrogen to reflux (120° C.) and then to a maximum temperature of 155° C. for 7 hours while collecting water in a Dean-Stark trap.

To another reactor are charged 220 parts of the foregoing reaction product, 46.9 parts of N,N-dimethyl-1,3-propanediamine (Eastman) and 114.4 parts of aromatic hydrocarbon solvent. The materials are heated under nitrogen at 110°–120° C. for 4 hours after which time the infrared spectrum shows no lactone remains. The materials are filtered employing a diatomaceous earth filter aid at 100°–110° C. at a pressure no lower than 100 millimeters mercury (13.3 kPa). The filtrate contains, by analysis, 3.33 percent nitrogen.

EXAMPLE 26

A reactor is charged with 220 parts of the nonylphenol-glyoxylic reaction product described in Example 25, 59.4 parts of N-aminoethylpiperazine (Union Carbide) and 93.1 parts aromatic hydrocarbon solvent. The materials are heated under nitrogen at 100°–110° C. for 4 hours after which time the infrared analysis shows no lactone remains. The materials are filtered employing a diatomaceous earth filter aid at 100° C. at a pressure not lower than 100 millimeters mercury (13.3 kPa). The filtrate contains, by analysis, 5.18 percent nitrogen.

EXAMPLE 27

A reactor is charged with 3005 parts of the polypropylene-substituted phenol described in Example 14, 439 parts 50 percent aqueous glyoxylic acid (Aldrich) and 4.2 parts paratoluene sulfonic acid monohydrate (Eastman). The materials are heated with stirring and below surface nitrogen blowing to 170° C. over 4 hours while holding the temperature at 170° C. for 3 hours, removing a total of 298 parts water. The materials are filtered hot employing a diatomaceous earth filter aid.

Another reactor is charged with 450 parts of the foregoing reaction product and 66.6 parts of aminoguanidine bicarbonate (Aldrich) followed by heating under nitrogen to 150° C. The materials are held at 150°–160° C. for 10 hours while collecting 10 parts water in a Dean-Stark trap. Xylene (162 parts) is added, the materials are stirred for 0.5 hours and vacuum filtered employing a diatomaceous earth filter aid at a temperature of 110°–120° C. at a pressure not less than 100 millimeters mercury (13.3 kPa). The filtrate contains, by analysis, 3.89 percent nitrogen.

EXAMPLES 28–34

Reaction products are prepared substantially according to the procedure of Example 1, replacing the polybutene substituted phenol with an equivalent amount, based on the molecular weight, of the alkylated hydroxy aromatic compounds listed in the following Table I:

TABLE I

| Example | Name | Mol. Wt.[1] |
|---|---|---|
| 28 | 2,2'-dipoly(isobutene)yl-4,4'-dihydroxybiphenyl | 2500 |
| 29 | 8-hydroxy-poly(propene)yl-1-azanaphthalene | 900 |
| 30 | 4-poly(isobutene)yl-1-naphthol | 1700 |
| 31 | 2-poly(propene/butene-1)yl-4,4'-isopropylidene-bisphenol[2] | 3200 |
| 32 | 4-tetra(propene)yl-2-hydroxy-anthracene | — |
| 33 | 4-octadecyl-1,3-dihydroxybenzene | — |
| 34 | 4-poly(isobutene)-3-hydroxy-pyridine | 1300 |

[1]Number average molecular weight by vapor phase osmometry
[2]The molar ratio of propene to butene-1 in the sustituent is 2:3.

EXAMPLE 35

The procedure of Example 3 is repeated except the polybutene has an average molecular weight of about 1400.

EXAMPLE 36

The procedure of Example 9 is repeated employing a substituted phenol (having an —OH content of 1.88%, prepared by reacting polyisobutenyl chloride having a viscosity at 99° C. of 1306 SUS (Sayboldt Universal Seconds) and containing 4.7% chlorine with 1700 parts phenol).

EXAMPLE 37

The procedure of Example 15 is repeated replacing the propylene tetramer substituted phenol with an equivalent number of moles of a sulfurized alkylated phenol prepared by reacting 1000 parts of a propylene tetramer substituted phenol as described in Example 2 with 175 parts of sulfur dichloride and diluted with 400 parts mineral oil.

EXAMPLE 38

The procedure of Example 37 is repeated replacing the sulfurized phenol with a similar sulfurized phenol prepared by reacting 1000 parts of propylene tetramer substituted phenol with 319 parts of sulfur dichloride.

EXAMPLE 39

The procedure of Example 1 is repeated replacing glyoxylic acid with an equivalent amount, based on —COOH, of pyruvic acid.

EXAMPLE 40

The procedure of Example 6 is repeated replacing glyoxylic acid with an equivalent amount, based on —COOH, of levulinic acid.

EXAMPLE 41–43

The procedure of Example 3 is repeated employing the keto alkanoic acids given in Table II.

TABLE II

| Example | Acid |
|---|---|
| 41 | Pyruvic |
| 42 | 3-Ketobutyric |
| 43 | Keto valeric |

EXAMPLE 44

The procedure of Example 4 is repeated replacing glyoxylic acid with an equivalent amount, based on —COOH, of omega-oxo-valeric acid.

EXAMPLES 45–48

The procedures of each of Examples 1–4 is repeated replacing the alkylated phenol with a propylene tetramer-substituted catechol.

EXAMPLE 49

To a reactor is charged 1650 parts of the reaction product of Example 16. The materials are heated under nitrogen to 130°–135° C. at which time 34.8 parts propylene oxide are added over 3 hours. The materials are heated at 135° C. for 2 hours and at 140° C. for 1 hour followed by vacuum filtration at 100°–110° C. at a pressure not lower than 100 millimeters mercury (13.3 kPa) employing a diatomaceous earth filter aid. The filtrate contains, by analysis, 1.41 percent nitrogen.

EXAMPLE 50

A reactor is charged with 220 parts of the nonylphenol-glyoxylic acid reaction product of Example 25, 59.4 parts of N-aminoethylpiperazine (Union Carbide) and 131.3 parts of aromatic hydrocarbon solvent. The materials are heated under nitrogen at 110°–120° C. for 1 hour, the temperature is raised to 125° C. and 28 parts propylene oxide are added at 125°–130° C. over 3 hours. The materials are heated at 135°–140° C. for 2 hours, cooled to 110° C. and vacuum filtered at 100°–110° C. at a pressure not lower than 100 millimeters mercury (13.3 kPa) employing a diatomaceous earth filter aid.

EXAMPLE 51

A reactor is charged with 600 parts of the reaction product of Example 2 and the materials are heated to 120° C. under nitrogen. Propylene oxide (24 parts) is added at 120°–130° C. over 4 hours, followed by heating at 120°–130° C. for 3 additional hours.

EXAMPLE 52

A reactor is charged with 800 parts of the reaction product from Example 9. The materials are heated under nitrogen to 125° C. followed by the addition of 23.7 parts propylene oxide over a 6 hour period at 125°–130° C. A dry-ice condenser is employed. The reaction mixture is heated to 130° C. and held at 130°–135° C. for 6 additional hours. The materials are filtered employing diatomaceous earth at 130°–135° C. The materials contain, by analysis, 1.60 percent nitrogen.

EXAMPLE 53

Following substantially the same procedure as described in Example 51, 600 parts of the reaction product from Example 2 are reacted with 12 parts of propylene oxide.

EXAMPLE 54

A reactor is charged with 7000 parts of polybutene-substituted phenol described in Example 1, 460 parts of 50 percent aqueous glyoxylic acid (Aldrich) and 4.8 parts paratoluene sulfonic acid monohydrate (Eastman). The materials are heated under nitrogen at 155°–160° C. for 6 hours collecting 315 parts water in a Dean-Stark trap. The material has a saponification number of 29.6 and shows a molecular weight by gel permeation chromatography of 3019.

Another reactor is charged with 778 parts of the foregoing reaction product and 43.9 parts of aminoethylpiperazine (Union Carbide). The materials are heated under nitrogen at 110°–115° C. for 3 hours. Xylene, 280.5 parts, is added and the materials are heated to 130° C. followed by the addition of 21.7 parts propylene oxide at 130°–135° C. over 3 hours. The reaction heating is continued at 135°–140° C. for 4 hours followed by vacuum filtration employing a diatomaceous earth filter aid at 110°–120° C. and a pressure not less than 100 millimeters mercury (13.3 kPa). The infrared analysis shows no lactone carbonyl is present. The filtrate contains, by analysis, 1.29 percent nitrogen.

EXAMPLE 55

A reactor is charged with 5640 parts of polybutene-substituted phenol as described in Example 1, 371 parts of 50 percent aqueous glyoxylic acid (Hoechst Celanese) and 2.83 parts 70 percent aqueous methane sulfonic acid. The materials are heated over 2.5 hours to 155° C. and are held at 155°–160° C. for 3 hours collecting 250 parts water in a Dean-Stark trap.

Xylene, 2068 parts, is added and the reaction is cooled to 85° C. followed by addition of 323 parts N-aminoethylpiperazine (Union Carbide) which is accompanied by a slight exothermic reaction. The materials are heated over 1.5 hours to 150° C. and held at 150°–155° C. for 1 additional hour collecting 7 additional grams aqueous distillate. The materials are cooled to 130° C. and 158 parts propylene oxide is added over a 3 hour period, the materials are heated followed by vacuum filtration. The filtrate contains, by analysis, 1.30 percent nitrogen.

EXAMPLE 56

A reactor is charged with 400 parts of the alkylated phenol-glyoxylic acid reaction product of Example 13 and 39.1 parts of diethylene triamine. The materials are heated under nitrogen at 120°-125° C. for 7 hours while collecting aqueous distillate in a Dean-Stark trap. Propylene oxide is added under nitrogen at 120°-130° C. over 4 hours. Heating is continued at 120°-130° C. for 3 additional hours. The materials are filtered employing a diatomaceous earth filter aid at 120°-130° C.

EXAMPLE 57

A reactor is charged with 1309 parts of a phenol-glyoxylic acid reaction product as described in Example 14, 170 parts N-aminoethylpiperazine (Union Carbide) and 520 parts xylene. The materials are heated under nitrogen to 150° C. over 2 hours and held at that temperature for 1 hour obtaining 1 part water in a trap. To this product are added 85.7 parts propylene oxide over 3.5 hours at 120°-130° C. followed by heating at 125°-130° C for 3 hours. The materials are vacuum filtered employing a diatomaceous earth filter aid at 110°-115° C. at a pressure not less than 100 millimeters mercury (13.3 kPa).

EXAMPLE 58

The procedure of Example 1 is repeated except that the aromatic hydrocarbon solvent solution of the polybutene-substituted phenol-glyoxylic acid reaction product is added to the diethylenetriamine.

As indicated hereinabove, the amides of this invention may be used as additives for normally liquid fuels.

The fuels used in the fuel compositions of this invention are well known to those skilled in the art and usually contain a major portion of a normally liquid fuel such as hydrocarbonaceous petroleum distillate fuel (e.g., motor gasoline as defined by ASTM Specifications D-439-89 and D-4814-91 and diesel fuel or fuel oil as defined in ASTM Specifications D-396-90 and D-975-91). Fuels containing non-hydrocarbonaceous materials such a alcohols, ether, organo-nitro compounds and the like (e.g., methanol, ethanol, diethyl ether, methyl ethyl ether, nitromethane) are also within the scope of this invention as are liquid fuels derived from vegetable or mineral sources. Vegetable or mineral sources include, for example, crude petroleum oil, coal, corn, shale, oilseeds and other sources.

Oxygenates are compounds covering a range of alcohol and ether type compounds. They have been recognized as means for increasing octane value of a base fuel. They have also been used as the sole fuel component, but more often as a supplemental fuel used together with, for example, gasoline to form the well-known "gasohol" blend fuels. Oxygenate-containing fuels are described in ASTM D-4814-91.

Methanol and ethanol are the most commonly used oxygenates. They are primarily used as fuels. Other oxygenates, such as ethers, for example methyl-t-butyl ether, are more often used as octane number enhancers for gasoline.

Mixtures of fuels are useful. Examples of fuel mixtures are combinations of gasoline and ethanol, diesel fuel and ether, gasoline and nitromethane, etc.

Particularly preferred fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel compositions of the present invention may contain other additives which are well known to those of skill in the art. These can include anti-knock agents such as tetra-alkyl lead compounds, lead scavengers such as halo-alkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers, anti-icing agents and the like. The fuel compositions of this invention may be lead-containing or lead-free fuels. Preferred are lead-free fuels.

As mentioned hereinabove, in one embodiment of this invention, the motor fuel compositions contain an amount of additives sufficient to provide total intake system cleanliness. In another embodiment, they are used in amounts sufficient to prevent or reduce the formation of intake valve deposits or to remove them where they have formed.

As mentioned hereinabove, fluidizer oils may be used in the fuel compositions of the instant invention. Useful fluidizer oils include natural oils or synthetic oils, or mixtures thereof. Natural oils include mineral oils, vegetable oils, animal oils, and oils derived from coal or shale. Synthetic oils include hydrocarbon oils such as alkylated aromatic oils, olefin oligomers, esters, including esters of polycarboxylic acids and polyols, and others.

Especially preferred mineral oils are paraffinic oils containing no more than about 20% unsaturation, that is, no more than 20% of the carbon to carbon bonds are olefinic.

Particularly useful synthetic oils are the polyether oils such as those marketed under the UCON tradename by Union Carbide Corporation and polyester oils derived from a polyol and one or more monocarboxylic acids such as those marketed by Hatco Corporation.

Preferably, the fluidizer oils have a kinematic viscosity ranging from about 2 to about 25 centistokes at 100° C., preferably from about 4 to about 20 centistokes, and often up to about 15 centistokes. If the viscosity of the fluidizer oil is too high, a problem that may arise is the development of octane requirement increase (ORI) wherein the octane value demands of the engine tend to increase with time of operation.

While both mineral oils and synthetic oils are generally useful as fluidizer oils over the entire preferred viscosity range, it has been observed that at the lower end of the viscosity range, synthetic oils tend to provide somewhat superior performance compared to mineral oils.

It has been found that fluidizer oils, particularly when used within the ranges specified herein, together with the amides of this invention, improve detergency and reduce the tendency toward valve sticking. Amounts of the various additives, including individual amounts to be used in the fuel composition, and relative amounts of additives are given hereinafter.

The fuel compositions of this invention may contain auxiliary dispersants. A wide variety of dispersants are known in the art and may be used together with the amide compounds described herein. Preferred auxiliary dispersants are Mannich type dispersants, acylated nitrogen-containing dispersants, aminophenol dispersants, aminocarbamate dispersants, ester dispersants and amine dispersants.

Acylated nitrogen-containing compounds include reaction products of hydrocarbyl-substituted carboxylic acylating agents such as substituted carboxylic acids or derivatives thereof with ammonia or amines. Especially preferred are succinimide dispersants.

Acylated nitrogen-containing compounds are known in the art and are disclosed in, for example, U.S. Pat. Nos. 4,234,435; 3,215,707; 3,219,666; 3,231,587 and 3,172,892, which are hereby incorporated by reference for their disclosures of the compounds and the methods of preparation.

The auxiliary dispersant may also be an ester. These compounds are prepared by reacting a hydrocarbyl-substituted carboxylic acylating agent with at least one organic hydroxy compound. In another embodiment, the ester dispersant is prepared by reacting the acylating agent with a hydroxyamine. Preferred are succinic esters.

Carboxylic esters and methods of making the same are known in the art and are disclosed in U.S. Pat. Nos. 3,219,666, 3,381,022, 3,522,179 and 4,234,435 which are hereby incorporated by reference for their disclosures of the preparation of carboxylic ester dispersants.

The carboxylic esters may be further reacted with at least one amine and preferably at least one polyamine. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

Also included among the auxiliary dispersants are Mannich type dispersants. Mannich products are formed by the reaction of at least one aldehyde, at least one amine having at least one N-H group and at least one hydroxyaromatic compound.

Mannich products are described in the following patents: U.S. Pat. No. 3,980,569; U.S. Pat. No. 3,877,899; and U.S. Pat. No. 4,454,059 (herein incorporated by reference for their disclosure to Mannich products).

The auxiliary dispersant may be a polyalkene-substituted amine. Polyalkene-substituted amines are well known to those skilled in the art. Typically, polyalkene-substituted amines are prepared by reacting olefins and olefin polymers (polyalkenes) and halogenated derivatives thereof with amines (mono- or polyamines). These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Aminophenols are also included among useful auxiliary dispersants that may be used in the fuel composition of this invention. Typically, such materials are prepared by reducing hydrocarbyl substituted nitrophenols to the corresponding aminophenol. Useful aminophenols include those described in Lange, U.S. Pat. Nos. 4,320,000 and 4,320,021. Aminophenols and methods for preparing are also described in U.S. Pat. Nos. 4,100,082 and 4,200,545 to Clason et al, U.S. Pat. No. 4,379,065 (Lange) and U.S. Pat. No. 4,425,138 (Davis). It should be noted that the term "phenol" used in the context of aminophenols is not intended to limit the compounds referred to in that manner as being only hydroxybenzene derivatives. The term "phenol" is intended to encompass hydroxy aromatic compounds, including hydroxybenzene compounds, naphthols, catechols and others as described in the foregoing patents, all of which are incorporated herein by reference for relevant disclosures contained therein.

Also included among useful auxiliary dispersants are aminocarbamate dispersants such as those described in U.S. Pat. No. 4,288,612, which is incorporated herein by reference for relevant disclosures contained therein.

Treating levels of the additives used in this invention are often described in terms of pounds per thousand barrels (PTB) of fuel.

PTB values may be converted to approximate values expressed as parts (by weight) per million parts (by weight) of fuel by multiplying by 4 for gasoline and by 3.3 for diesel oil and fuel oil. To determine precise values it is necessary that the specific gravity of the fuel is known. The skilled person can readily perform the necessary mathematical calculations.

The fuel compositions of this invention typically contain from about 5 to about 500 pounds per thousand barrels (PTB) of fuel additive, preferably from about 10 to about 250 PTB, more preferably from about 20 to about 100 PTB.

Fluidizer oils, when used, are generally present in amounts ranging from about 1 to about 500 PTB, more often from about 10 to about 250 PTB and most preferably from about 10 to about 150 PTB.

Relative amounts of the amide-containing compound (I) to fluidizer oil typically range from about 1:0 to 1:10, more often from about 1:0.1 to 1:5, preferably from about 1:0.1 to 1:2.

The following examples illustrate several fuel compositions of this invention. When referring to examples of compounds described in Examples 1–57, amounts are given in parts and percentages by weight as prepared. Unless indicated otherwise, all other parts and percentages are by weight and amounts of additives are expressed in amounts substantially free of mineral oil or hydrocarbon solvent diluent. The abbreviation 'PTB' means pounds of additive per thousand barrels of fuel.

Table I illustrates several fuel compositions of the instant invention comprising unleaded gasoline and the indicated amounts of additive in pounds per thousand barrels of gasoline.

TABLE I

| PRODUCT OF | GASOLINE + PTB ADDITIVE | | | | | | | | |
|---|---|---|---|---|---|---|---|---|---|
| EXAMPLE | A | B | C | D | E | F | G | H | I |
| 1 | 66.7 | 400 | | 67 | 67 | 91.7 | 91.7 | 66.7 | 67 |
| 12 | | | | | | | 66.7 | 66.7 | |
| 7 | | | 100 | | | | | | |
| Polyether oil | | | | | | | 25 | | 25 |
| Xylene | | | | | 33 | | | | 28 |
| Mineral Oil | | | | 50 | 50 | | | | |
| Alkylated aromatic hydrocarbon | 66.7 | 400 | 100 | 117 | | | | | |

The following Table illustrates additive concentrates for use in fuels.

TABLE II

| Component | Concentrate (% by weight) I | II | III | IV | V | VI | VII |
|---|---|---|---|---|---|---|---|
| Alkylated aromatic hydrocarbon[1] | 50 | 50 | 50 | 50 | | 50 | |
| Product of Example 1 | 50 | | | 28.63 | 44.67 | 36.37 | 55.83 |
| Product of Example 12 | | 36.37 | | | | | |
| Polyether oil[2] | | 13.63 | | | | 13.63 | 20.83 |
| Product of Example 7 | | | 50 | | | | |
| Mineral oil | | | | 21.37 | 33.33 | | |
| Xylene | | | | | 22 | | 23.34 |

[1] = HISOL 10, Ashland Chemical Co.
[2] = UCON LB-135, Union Carbide

The following data demonstrate the unexpected benefit of the fuel compositions of this invention. The fuels were evaluated using the BMW intake valve deposit test.

The fuel evaluation procedure is based on 10,000 miles of driving in the BMW model 318i vehicle equipped with 1.8L 4-cylinder engine and automatic transmission. The testing is initiated with new, carefully weighed intake valves. This is followed by 10,000 miles of operation with the candidate fuel, and then disassembly of the cylinder head to reweigh the intake valves.

The primary data consist of intake valve deposit ratings and weights, and photographs of the intake valves. The significant data, however, is the actual deposit weight on the intake valves at 10,000 miles. Fuels are then classified in one of the three categories based on the following criteria established for the average of the four intake valves:

1) 100 milligrams maximum: meets BMW-NA standards of intake valve cleanliness for unlimited mileage.
2) 250 milligrams maximum: meets BMW-NA standard of intake valve cleanliness up to 50,000 miles.
3) More than 250 milligrams: does not meet BMW-NA standards of intake valve cleanliness.

The effect of the fuel compositions of this invention on intake valve deposits measured employing the BMW test is shown in the following table:

| FUEL | VALVE DEPOSIT WEIGHT (Mg/VALVE) #1 | #2 | #3 | #4 | Average |
|---|---|---|---|---|---|
| 1. Unleaded gasoline | 153.7, 340.2 | 132.1, 242.9 | 81.3, 272.8 | 194.7, 246.0 | 170.5, 250.5 |
| 2. Unleaded gasoline plus additives (Fuel of Example A) | 0.0, 24.0 | −1.3, 73.1 | 8.2, 44.0 | 5.4, 47.4 | 3.1 47.1 |

The Daimler-Benz M102E Test is also used to evaluate performance of fuel and fuel additive formulations with respect to their influence on intake system deposit accumulation.

The test employs a 4 cylinder, 4-stroke 2.3 liter gasoline engine with KE jettonic fuel management system. Power absorption is via dynamometer.

Each test employs a set of new intake valves carefully weighed, locked to prevent valve rotation.

The engine is operated for 60 hours, completing 800 four and one-half minute cycles, as described in the following table:

| STAGE | TIME (min) | SPEED (RPM) ±50 | TORQUE kgM ±0.2 | POWER kW |
|---|---|---|---|---|
| 1 | 0.5 | 800 | No load | Min |
| 2 | 1.0 | 1300 | 3.0 | 4.0 |
| 3 | 2.0 | 1850 | 3.3 | 6.3 |
| 4 | 1.0 | 3000 | 3.6 | 11.0 |

At the end of the test, the intake valves are removed from the cylinder head. The tulip section of the valve is visually inspected and rated, then each valve is weighed to determine the total weight of deposits accumulated on each valve during the test.

The effect of the fuel compositions of this invention on intake valve deposits measured employing the M102E test is shown in the following table.

| Fuel | Valve Deposit Weight (Mg/Valve) #1 | #2 | #3 | #4 | Average |
|---|---|---|---|---|---|
| 1. Unleaded gasoline | 254.5 | 325.5 | 348.9 | 168.0 | 274.2 |
| 2. Unleaded gasoline plus additives (Fuel of Example B) | 115.4 | 79.1 | 77.2 | 46.7 | 79.6 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A fuel composition comprising a major amount of a normally liquid fuel and a minor amount of at least one compound of the general formula (I)

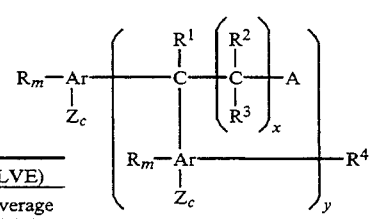

wherein each Ar is independently an aromatic group having from 5 to about 30 carbon atoms and from 0 to 3 optional substituents selected from the group consisting of amino, hydroxy- or alkyl- polyoxyalkyl, nitro, aminoalkyl, carboxy or combinations of two or more of said optional substituents, each R is independently a hydrocarbyl group, $R^1$ is H or a hydrocarbyl group, $R^2$ and $R^3$ are each, independently, H or a hydrocarbyl group, $R^4$ is selected from the group consisting of H, a hydrocarbyl group, a member of the group of optional substituents on Ar or lower alkoxy, each m is independently 0 or an integer ranging from 1 to about 6, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide or an amide-containing group, a carboxyl group, an ester group, an imidazoline-containing group, an oxazoline-containing group, an acylamino group or when one Z and A are taken together, a lactone group of the formula

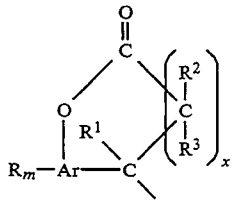

(XIV)

provided at least one A is an amide or an amide-containing group.

2. A fuel composition according to claim 1 having at least one R containing from 4 to about 750 carbon atoms.

3. A fuel composition according to claim 2 wherein each R is independently an aliphatic group.

4. A fuel composition according to claim 1 wherein each m is 1 or 2 and each R is an alkyl or alkenyl group.

5. A fuel composition according to claim 4 wherein R contains from 30 to about 100 carbon atoms and is derived from homopolymerized and interpolymerized $C_{2-10}$ olefins.

6. A fuel composition according to claim 5 wherein the olefins are 1-olefins.

7. A fuel composition according to claim 6 wherein the 1-olefins are ethylene, propylene, butenes and mixtures thereof.

8. A fuel composition according to claim 4 Wherein R contains from 7 to about 28 carbon atoms.

9. A fuel composition according to claim 4 wherein R contains from 12 to about 50 carbon atoms.

10. A fuel composition according to claim 4 wherein m is 2, and each Ar contains one tertiary-butyl substituent and one alkyl or alkenyl substituent containing from about 4 to about 100 carbon atoms.

11. A fuel composition according to claim 1 wherein each Ar is independently a linked aromatic group.

12. A fuel composition according to claim 11 wherein at least one Ar is a linked aromatic group corresponding to the formula $$ar\ (L\text{-}ar)_W$$

wherein each ar is a single ring or a fused ring aromatic nucleus of 5 to about 12 carbons, w is an integer ranging from 1 to about 6 and each L is independently selected from the group consisting of carbon to carbon single bonds between ar nuclei, ether linkages, sulfide linkages, polysulfide linkages, sulfinyl linkages, sulfonyl linkages, lower alkylene linkages, di(lower alkyl) methylene linkages, lower alkylene ether linkages, lower alkylene sulfide and/or polysulfide linkages, amino linkages and linkages having the formula

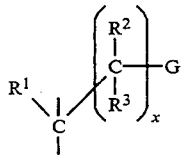

(II)

wherein each of $R^1$, $R^2$ and $R^3$ is independently H, alkyl or alkenyl, each G is independently an amide or an amide-containing group, a carboxyl group, an ester group, an oxazoline-containing group, or an imidazoline containing group, and x is an integer ranging from 0 to about 8, and mixtures of such linkages.

13. A fuel composition according to claim 1 wherein at least one Ar is a member of the group consisting of a benzene nucleus, a lower alkylene bridged benzene nucleus or a naphthalene nucleus.

14. A fuel composition according to claim 13 wherein each Z is OH, m and c are each one, x is 0, and Ar has no optional substituents, and $R^1$=H.

15. A fuel composition according to claim 1 wherein each of $R^1$, $R^2$, $R^3$ and $R^4$ is independently hydrogen or a lower alkyl or alkenyl group.

16. A fuel composition according to claim 1 wherein at least one Z is —OH.

17. A fuel composition according to claim 1 wherein at least one Z is $-(OR^5)_bOR^6$.

18. A fuel composition according to claim 15 wherein $R^5$ is a lower alkylene group and $R^6$ is a lower alkyl group.

19. A fuel composition according to claim 1 wherein at least one A has the general formula

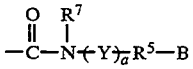

(V)

wherein each Y is a group of the formula

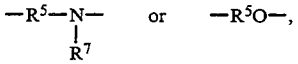

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hdyroxyalkyl-substituted amino hdyrocarbyl group, and B is an imide-containing group or an acylamino group and a is 0 or a number ranging from 1 to about 100.

20. A fuel composition according to claim 19 wherein the group B is selected from acylamino groups of the formula

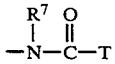

(VI)

wherein each $R^7$ is independently H, alkoxyalkyl, hdyroxyalkyl, hydrocarbyl, aminohydrocarbyl or an N-alkoxyalkyl- or N-hydroxyalkyl- substituted amino hydrocarbyl group and T is hydrocarbyl, groups of the formula (VII)

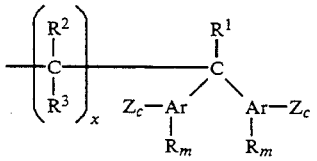

wherein each Ar is independently an aromatic group having from 5 to about 30 carbon atoms and from 0 to 3 optional substituents selected from the group consisting of amino, hydroxy- or alkyl- polyoxyalkyl, nitro, aminoalkyl, carboxy or combinations of two or more of said optional substituents, each R is independently a hydrocabyl group, $R^1$ is H or a hydrocarbyl group, $R^2$ and $R^3$ are each, independently, H or a hydrocarbyl group, each m is independently 0 or an integer ranging form 1 to about 6, x ranges from 0 to about 8, and each Z is independently OH, lower alkoxy, $(OR^5)_bOR^6$ or $O^-$ wherein each $R^5$ is in independently a divalent hydrocarbyl group, $R^6$ is H or hydrocarbyl and b is a number ranging from 1 to about 30 and c ranges from 1 to about 3, and wherein the sum m+c does not exceed the number of valances of the corresponding Ar available for substitution, or an imide-containing group.

21. A fuel composition according to claim 19 wherein the group B is selected from acylamino groups of the formula (VI)

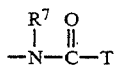

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula (VII)

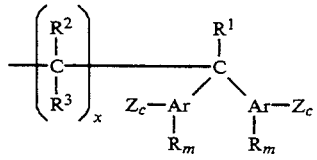

wherein each Ar is independently an aromatic group having from 5 to about 30 carbon atoms and from 0 to 3 optional substituents selected from the group consisting of amino, hydroxy- or alkyl- polyoxyalkyl, nitro, carboxy or combinations of two or more of said optional substituents, each R is independently a hydrocarbyl group, $R^1$ is H or a hydrocarbyl group, $R^2$ and $R^3$ are each, independently, H or a hydrocarbyl group, each m is independently 0 or an integer ranging from 1 to about 6, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, and wherein the sum m+c does not exceed the number of valences of the corresponding Ar available for substitution, and imide-containing groups.

22. A fuel composition according to claim 1 wherein at least one A has the formula (VIII)

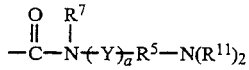

wherein each Y is a group of the formula

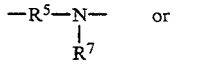

each $R^5$ is independently a divalent hydrocarbyl group, each $R^{11}$ is independently H, alkoxyalkyl, hydroxyalkyl or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted aminohydrocarbyl group and a is 0 or a number ranging from 1 to about 100.

23. A fuel composition according to claim 1 wherein at least one A has the formula (IX)

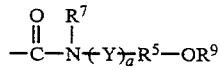

wherein each Y is a group of the formula

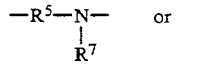

each $R^5$ is independently a divalent hydrocarbyl group, each $R^9$ is independently H or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted aminohydrocarbyl group and a is a number ranging from 0 to about 6.

24. A composition according to claim 1 wherein the compound (I) is present in an amount effective to provide total fuel intake system cleanliness in a port fuel injected internal combustion engine.

25. A fuel composition according to claim 1 which further comprises a fluidizer oil.

26. A fuel composition according to claim 1 which further comprises an auxiliary dispersant selected from the group consisting of Mannich dispersants, acylated nitrogen dispersants, aminophenol dispersants, ester dispersants, aminocarbamate dispersants and amine dispersants.

27. A composition according to claim 1 wherein the compound (I) is present in an amount effective to provide fuel injector and intake valve cleanliness in a port fuel injected internal combustion engine.

28. A fuel composition according to claim 1 wherein the normally liquid fuel comprises gasoline.

29. A fuel composition according to claim 28 wherein the normally liquid fuel further comprises oxygenates.

30. A fuel composition comprising a major amount of a normally liquid fuel and a minor amount of at least one compound of the general formula

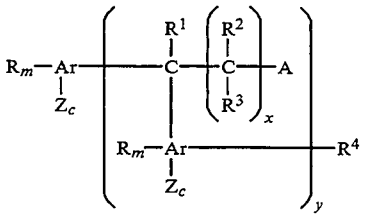

(I)

wherein each Ar is independently an aromatic group, at least one Ar has the formula

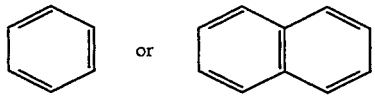

and having from 0 to 3 optional substituents selected from the group consisting of amino, hydroxy- or alkyl-polyoxyalkyl, nitro, carboxy or combinations of two or more of said optional substituents, each R is independently a hydrocarbyl group, $R^1$ is H or an alkyl group, $R^2$ and $R^3$ are each, independently, H or a hydrocarbyl group, each m is independently 0 or an integer ranging from 1 to about 6, n ranges from 0 to about 8 and each, independently, H or an alkyl group, $R^4$ or an alkyl group, each m is independently 0 or an integer ranging from 1 to about 10, x ranges from 0 to about 8, and each m is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide group or an amide-containing group.

31. A fuel composition according to claim 30 wherein at least one R contains from 7 to about 100 carbon atoms and m is 1 or 2.

32. A fuel composition according to claim 31 wherein each R is a substantially saturated aliphatic group.

33. A fuel composition according to claim 31 wherein each R contains from about 7 to about 28 carbon atoms and each m is 1.

34. A fuel composition according to claim 31 wherein each R contains at least about 30 carbon atoms and m is 1.

35. A fuel composition according to claim 31 wherein each R contains from 12 to about 50 carbon atoms and m is 1.

36. A fuel composition according to claim 31 wherein c is 1.

37. A fuel composition, according to claim 30 wherein $R^1$ is H or a lower alkyl group, $R^2$ and $R^3$ are independently H or a lower alkyl group, $R^4$ is H or a lower alkyl or alkylene group and x is 0, 1 or 2.

38. A fuel composition according to claim 30 wherein each Ar is

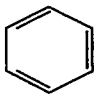

and each Z is OH.

39. A fuel composition according to claim 30 wherein m is 2, and each Ar contains one tertiary-butyl substituent and one alkyl or alkenyl substituent containing from about 12 to about 100 carbon atoms.

40. A fuel composition according to claim 30 wherein at least one A has the general formula

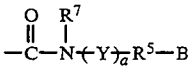

(V)

wherein each Y is a group of the formula

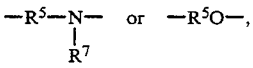

each $R^5$ is independently a divalent hdyrocarbyl group and each $R^7$ is independently H, alkoxyalkyl, hdyroxyalkyl, a hydrocarbyl group, an aminohydrocarbyl group, or an N-alkoxyalkyl or hydroxyalkyl substituted aminohydrocarbyl group, and B is an acylamino group, and a is a number ranging from 0 to about 6.

41. A fuel composition according to claim 40 wherein the group B is selected from acylamino groups of the formula

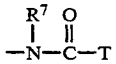

(VI)

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula

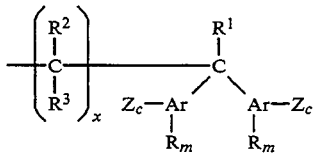

(VII)

wherein each Ar is independently an aromatic group having from 5 to about 30 carbon atoms and from 0 to 3 optional substituents selected from the group consisting of amino, hydroxy- or alkyl- polyoxyalkyl, nitro, carboxy or combinations of two or more of said optional substituents, each R is independently a hydrocarbyl group, $R^1$ is H or a hydrocarbyl group, $R^2$ and $R^3$ are each, independently, H or a hydrocarbyl group, each m is independently 0 or an integer ranging from 1 to about 6, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, and wherein the sum m+c does not exceed the number of valences of the corresponding Ar available for substitution, and imide-containing groups.

42. A fuel composition according to claim 30 wherein at least one A has the formula $$-\overset{O}{\overset{\|}{C}}-\overset{R^7}{\overset{|}{N}}\left(Y\right)_a R^5-N(R^{11})_2 \quad \text{(VIII)}$$

wherein each Y is a group of the formula $$-R^5-\underset{\underset{R^7}{|}}{N}- \quad \text{or} \quad -R^5O-,$$

each $R^5$ is independently a divalent hydrocarbyl group, each $R^{11}$ is independently H, alkoxyalkyl, hydroxyalkyl, or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted amino hydrocarbyl group, and a is 0 or a number ranging from 1 to about 100.

43. A fuel composition according to claim 30 wherein at least one A has the formula $$-\overset{O}{\overset{\|}{C}}-\overset{R^7}{\overset{|}{N}}\left(Y\right)_a R^5-OR^9 \quad \text{(IX)}$$

wherein each Y is a group of the formula $$-R^5-\underset{\underset{R^7}{|}}{N}- \quad \text{or} \quad -R^5O-,$$

each $R^5$ is independently a divalent hydrocarbyl group, each $R^9$ is independently H or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is 0 or a number ranging from 1 to about 100.

44. A composition according to claim 30 wherein the compound (I) is present in an amount effective to provide total fuel intake system cleanliness in a port fuel injected internal combustion engine.

45. A fuel composition according to claim 30 which further comprises a fluidizer oil.

46. A fuel composition according to claim 30 which further comprises an auxiliary dispersant selected from the group consisting of Mannich dispersants, acylated nitrogen containing dispersants, aminophenol dispersants, ester dispersants, aminocarbamate dispersants and amine dispersants.

47. A fuel composition comprising a major amount of a normally liquid fuel and a minor amount of at least one compound of the general formula

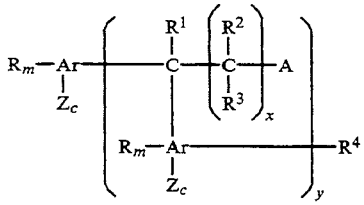

(I)

wherein each Ar is independently an aromatic group having from 5 to about 30 carbon atoms, wherein at least one Ar is an aromatic group of the formula

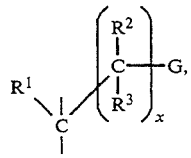

wherein each ar is a single ring or a fused ring aromatic nucleus of 5 to 12 carbons, w is an integer ranging from 1 to about 20 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages and linkages having the formula each Ar having from 0 to 3 optional substituents selected from the group consisting of amino, hydroxy- or alkylpolyoxyalkyl, nitro, carboxy or combinations of two or more of said optional substituents, each R is independently a hydrocarbyl group, $R^1$ is H or a hydrocarbyl group, $R^2$ and $R^3$ are each, independently, H or a hydrocarbyl group, $R^4$ is H or a hydrocarbyl group, each G is independently an amide or an amide-containing group, a carboxyl group, an ester group, an oxazoline-containing group or an imidazoline group, each m is independently 0 or an integer ranging from 1 to about 10, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and at least one A is independently an amide group or an amide-containing group.

48. A fuel composition according to claim 47 wherein L is selected from the group consisting of ether linkages, lower alkylene linkages or carbon to carbon single bonds between ar nuclei.

49. A fuel composition according to claim 47 wherein at least one ar is a group of the formula

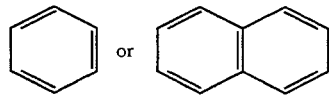

and w is 1, 2 or 3.

50. A fuel composition according to claim 47 wherein at least one Z is OH.

51. A fuel composition according to claim 47 wherein each ar has one substituent R having from 4 to about 100 carbon atoms and there are substantially no optional substituents on Ar.

52. A fuel composition according to claim 47 wherein each of $R^1$, $R^2$, $R^3$ and $R^4$ is independently hydrogen or a lower alkyl or alkenyl group.

53. A fuel composition according to claim 47 wherein at least one Z is —OH.

54. A fuel composition according to claim 47 wherein m is 2, and each Ar contains one tertiary-butyl substituent and one alkyl or alkenyl substituent containing from about 7 to about 100 carbon atoms.

55. A fuel composition according to claim 47 wherein at least one A has the general formula

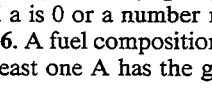

(V)

wherein each Y is a group of the formula

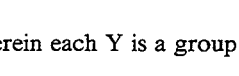

each $R^5$ is independently a divalent hydrocarbyl group and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group, and B is an acylamino group, and a is 0 or a number ranging from 1 to about 100.

56. A fuel composition according to claim 47 wherein at least one A has the general formula

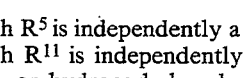

(VIII)

wherein each Y is a group of the formula

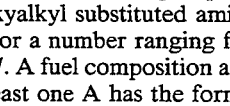

each $R^5$ is independently a divalent hydrocarbyl group, each $R^{11}$ is independently H, alkoxyalkyl, hydroxyalkyl, or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group, and a is 0 or a number ranging from 1 to about 100.

57. A fuel composition according to claim 47 wherein at least one A has the formula

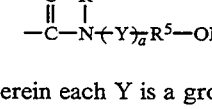

(IX)

wherein each Y is a group of the formula

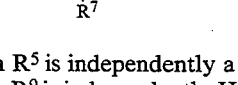

each $R^5$ is independently a divalent hydrocarbyl group each $R^9$ is independently H or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group, and a is 0 or a number ranging from 1 to about 100.

58. A composition according to claim 47 wherein the compound (I) is present in an amount effective to provide total fuel intake system cleanliness in a port fuel injected internal combustion engine.

59. A fuel composition according to claim 47 which further comprises a fluidizer oil.

60. A fuel composition according to claim 47 which further comprises an auxiliary dispersant selected from the group consisting of Mannich dispersants, acylated nitrogen dispersants, aminophenol dispersants, ester dispersants, aminocarbamate dispersants and amine dispersants.

61. A fuel composition comprising a major amount of at least one normally liquid fuel and at least one compound of the formula

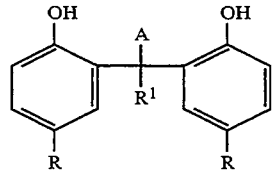

(II)

wherein $R^1$ is H or an alkyl or alkenyl group containing from 1 to about 20 carbon atoms and each R is independently a hydrocarbyl group containing from 4 to about 300 carbon atoms and A is an amide or an amide-containing group.

62. A fuel composition according to claim 61 wherein A is a group of the formula

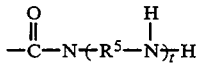

wherein $R^5$ is an ethylene, propylene or butylene group and t is a number ranging from 1 to about 4.

63. A fuel composition according to claim 61 wherein each R independently contains from 7 to about 28 carbon atoms.

64. A fuel composition according to claim 61 wherein each R independently contains an average of at least 30 carbon atoms.

65. A fuel composition according to claim 64 wherein each R is derived from polymerized or interpolymerized $C_{2-10}$ olefins.

66. A fuel composition according to claim 65 wherein the olefins are 1-olefins.

67. A fuel composition according to claim 66 wherein the olefins are selected from the group consisting of propylene, butenes and ethylene.

68. A fuel composition according to claim 67 wherein the olefin is propylene and R has a number average molecular weight ranging from 300 to about 2000.

69. A fuel composition according to claim 61 wherein each R contains from 7 to about 50 carbon atoms.

70. A composition according to claim 61 wherein the compound (II) is present in an amount effective to provide total fuel intake system cleanliness in a port fuel injected internal combustion engine.

71. A fuel composition according to claim 61 which further comprises a fluidizer oil.

72. A fuel composition according to claim 71 wherein the fluidizer oil is selected from the group consisting of mineral oil and synthetic oils having a viscosity measured at 100° C. of from about 2cSt to about 25cSt.

73. A fuel composition according to claim 61 which further comprises an auxiliary dispersant selected from the group consisting of Mannich dispersants, acylated nitrogen dispersants, ester dispersants, aminophenol dispersants, aminocarbamate dispersants and amine dispersants.

74. A fuel composition comprising a major amount of a normally liquid fuel and a minor amount of a composition prepared by reacting (a) at least one reactant of the formula $$R_m-\underset{\underset{(H)_s}{|}}{Ar}-Z_c \qquad \text{(XI)}$$

wherein R is an aliphatic hydrocarbyl group, m ranges from 0 to about 6, Ar is an aromatic group containing from 5 to about 30 carbon atoms having from 0 to 3 optional substituents selected from the group consisting of amino, hydroxy- or alkyl-polyoxyalkyl, nitro, aminoalkyl, carboxy or combinations of two or more said optional substituents, wherein s is an integer of at least 1 and c ranges from 1 to about 3, wherein the total of s+m+c does not exceed the number of valences of Ar available for substitution and Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 with (b) a carboxylic reactant of the formula $$R^1CO(CR^2R^3)_xCOOR^{10} \qquad \text{(XII)}$$

wherein $R^1$, $R^2$ and $R^3$ are independently H or a hydrocarbyl group, $R^{10}$ is H or an alkyl group, and x is an integer ranging from 0 to about 8 and then reacting the intermediate so formed with ammonia or an amine.

* * * * *